US009357898B2

(12) United States Patent
Monsrud et al.

(10) Patent No.: US 9,357,898 B2
(45) Date of Patent: Jun. 7, 2016

(54) METHOD OF SEPARATING CHEMISTRIES IN A DOOR-TYPE DISHMACHINE

(71) Applicant: Ecolab USA Inc., St. Paul, MN (US)

(72) Inventors: Lee J. Monsrud, Inver Grove Heights, MN (US); Jeffrey P. Ellingson, Minnetonka, MN (US); Brian P. Carlson, Lakeville, MN (US); Louis M. Holzman, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 642 days.

(21) Appl. No.: 13/712,375

(22) Filed: Dec. 12, 2012

(65) Prior Publication Data

US 2013/0146099 A1 Jun. 13, 2013

Related U.S. Application Data

(60) Provisional application No. 61/569,892, filed on Dec. 13, 2011.

(51) Int. Cl.

| | |
|---|---|
| ***B08B 3/04*** | (2006.01) |
| ***A47L 15/42*** | (2006.01) |
| *A47L 15/00* | (2006.01) |

(52) U.S. Cl.

CPC ..... *A47L 15/4214* (2013.01); *A47L 15/0028* (2013.01); *A47L 15/4221* (2013.01); *B08B 3/04* (2013.01); *A47L 15/0026* (2013.01); *A47L 2501/03* (2013.01); *A47L 2501/05* (2013.01); *A47L 2501/07* (2013.01)

(58) Field of Classification Search

CPC ..... A47L 15/4214; A47L 15/4221

See application file for complete search history.

(56) References Cited

U.S. PATENT DOCUMENTS

| | | | | |
|---|---|---|---|---|
| 3,620,232 | A | 11/1971 | D Angelo | |
| 5,879,469 | A * | 3/1999 | Avram | 134/25.2 |
| 7,942,978 | B2 | 5/2011 | Holzman et al. | |
| 8,092,613 | B2 | 1/2012 | Strothoff et al. | |
| 2002/0065205 | A1 | 5/2002 | Neplenbroek et al. | |
| 2004/0173244 | A1 | 9/2004 | Strothoff et al. | |
| 2004/0194810 | A1 | 10/2004 | Strothoff et al. | |
| 2006/0201537 | A1 | 9/2006 | Strothoff et al. | |
| 2007/0034234 | A1 * | 2/2007 | Holzman et al. | 134/10 |
| 2011/0180115 | A1 | 7/2011 | Holzman et al. | |

FOREIGN PATENT DOCUMENTS

| | | | |
|---|---|---|---|
| DE | 19940645 | A1 | 3/2001 |
| EP | 1 392 807 | B1 | 5/2002 |
| EP | 1 567 289 | B1 | 11/2003 |

(Continued)

OTHER PUBLICATIONS

Machine translation: DE19940645; Carlhoff et al.; 2001.*

(Continued)

*Primary Examiner* — Michael Kornakov
*Assistant Examiner* — Natasha Campbell
(74) *Attorney, Agent, or Firm* — Merchant & Gould P.C.

(57) ABSTRACT

The present disclosure relates to a dishmachine that includes at least two tanks and methods of using the tanks to isolate, substantially isolate, or incrementally isolate different chemistries from each other during a cycle. The disclosed dishmachine design and method allows for the use of two different, and potentially incompatible, reactive, or offsetting chemistries to be used in the same dishmachine cycle.

23 Claims, 20 Drawing Sheets

(56) References Cited

FOREIGN PATENT DOCUMENTS

| | | | |
|---|---|---|---|
| EP | 1477552 | A1 | 11/2004 |
| EP | 1 844 693 | A1 | 10/2007 |
| WO | WO 9524148 | A2 * | 9/1995 |
| WO | WO9830673 | A1 | 7/1998 |
| WO | WO 2004/052564 | A1 | 6/2004 |

OTHER PUBLICATIONS

International Search Report and Written Opinion for PCT/US2012/069277 mailed Apr. 29, 2013.

Extended European Search Report for European Application No. 12857600.6, Jun. 30, 2015, 6 pages.

* cited by examiner

METHOD OF SEPARATING CHEMISTRIES IN A DOOR-TYPE DISHMACHINE

CROSS REFERENCE TO RELATED APPLICATIONS

This application claims the benefit of U.S. Provisional Application No. 61/569,892, filed Dec. 13, 2011, entitled "Method of Separating Chemistries in a Door-Type Dishmachine," which is incorporated by reference herein in its entirety.

BACKGROUND

Dishmachines, particularly commercial dishmachines, have to effectively clean a variety of articles such as pots and pans, glasses, plates, bowls, and utensils. These articles include a variety of soils, including protein, fat, starch, sugar, and coffee and tea stains which can be difficult to remove. At times, these soils may be burned or baked on, or otherwise thermally degraded. Other times, the soil may have been allowed to remain on the surface for a period of time, making it more difficult to remove. Dishmachines remove soil by using strong detergents, high temperatures, sanitizers, or mechanical action from copious amounts of water. It is against this background that the present disclosure is made.

SUMMARY

The present disclosure relates to a dishmachine that includes at least two tanks and methods of using the tanks to isolate, substantially isolate, or incrementally isolate different chemistries from each other during a cycle. The disclosed dishmachine design and method allows for the use of two different, and potentially incompatible or reactive chemistries to be used in the same dishmachine cycle.

BRIEF DESCRIPTION OF THE DRAWINGS

FIG. 8-A shows an embodiment where the fluid flows off of the end of the ledge into tank A. FIG. 8-B shows an embodiment where the fluid wraps around the ledge and flows into tank B.

FIG. 10-A shows the flow into tank B. FIG. 10-B shows the flow into tank A.

FIG. 12-B shows the use of a deflector plate.

FIG. 15-A shows the flapper in position to divert fluid into tank A. FIG. 15-B shows the flapper in position to divert fluid into tank B.

FIG. 16-A shows the diverter. FIG. 16-B shows the gutter plate.

FIG. 17-A shows the diverter with the gutter plate and the strainer. FIG. 17-B shows a top view of the diverter with the gutter plate. FIG. 17-C shows two variations of the gutter plate.

Figure 1:
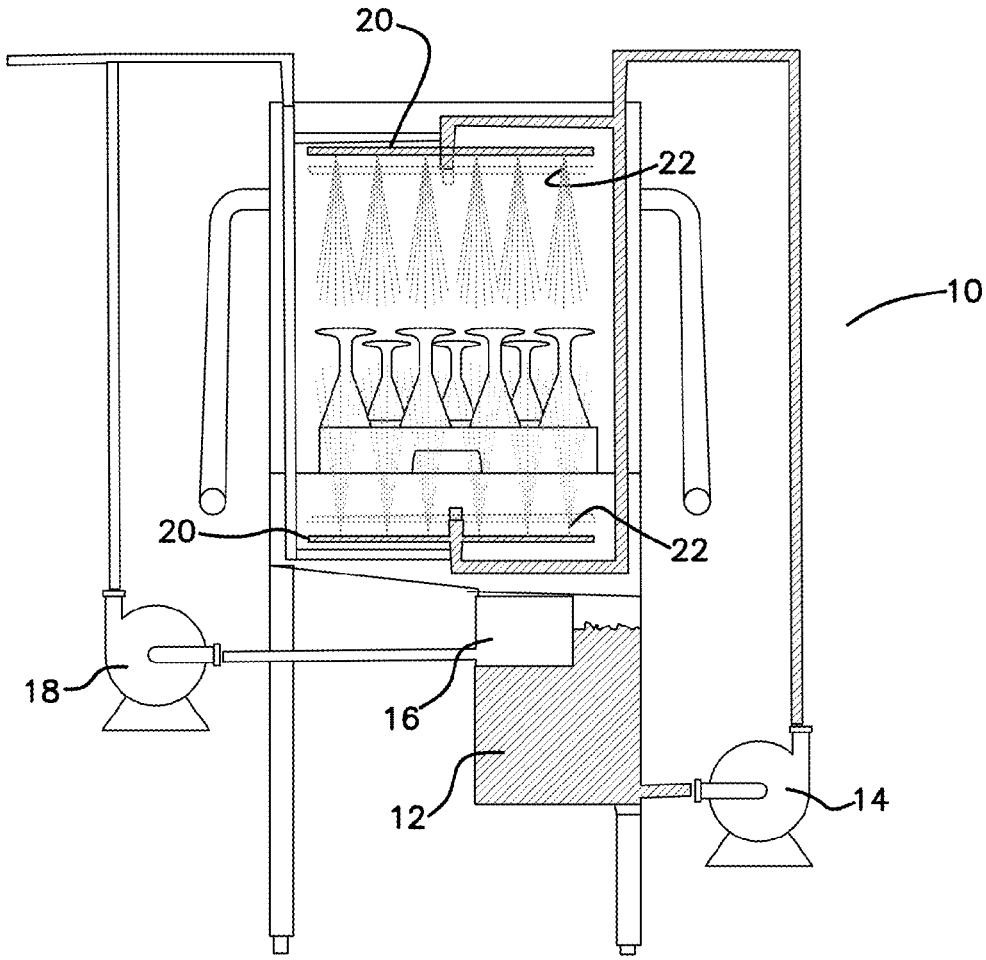
FIG. 1 illustrates the flow of composition from Tank A.

In accordance with common practice, the various described features are not drawn to scale but are drawn to emphasize specific features relevant to the disclosure. Reference characters denote like features throughout the Figures.

DETAILED DESCRIPTION

The present disclosure relates to a dishmachine that includes at least two tanks and methods of using the tanks. The dishmachine design allows for more than one chemical composition to be used during the dishmachine cycle where the two compositions can be isolated, substantially isolated, or incrementally isolated from each other. Separating the two chemistries in this way allows an operator to use incompatible, reactive, or offsetting chemistries in the same cycle to achieve an improved cleaning result. Exemplary chemistries are described in U.S. Pat. No. 8,092,613 directed to Methods and Compositions for the Removal of Starch. U.S. Pat. No. 8,092,613 describes soil removal using compositions in an alternating pH sequence. Such a system experiences improved soil removal but uses excessive amounts of water and neutralizes the detergent in a dishmachine with one tank. Once an alkaline detergent is neutralized, it is not as effective at removing soil. Likewise, certain chemical compositions, such as bleaching agents and enzymes, may be incompatible with other compositions used in the dishmachine, and therefore must remain separated to be effective.

Using the dishmachine disclosed herein with the different compositions allows for a system that uses less chemicals, less water, and less energy while providing excellent cleaning and rinsing results.

Method of Cleaning

The disclosed dishmachine design separates two different compositions and prevents them from mixing. Conventional door-type dishmachines and undercounter machines have one wash tank that contains an alkaline detergent that is circulated over the dishes. The disclosed invention provides for the addition of a second tank to a door-type or undercounter dishmachine where the second tank may contain different chemistry. Using the second tank enables different methods of cleaning articles in dishmachines that will now be discussed. For purposes of describing the disclosed method, the following abbreviations may be used:

Tank A refers to the wash tank with the main detergent or composition (A). This is most likely an alkaline detergent but may be neutral, or may be a unique formula that complements or is synergistic with the second tank chemical. For example, some of the ingredients of the alkaline detergent may be better formulated into the second composition, or vice versa.

Tank B refers to the tank containing the second composition (B). An acidic product has been found to provide special advantages, but other chemistries are also advantageous.

Examples of chemical compositions include bleaches, enzymes, or chelating agents. Tank B may additionally collect or contain fresh rinse water.

Wash A refers to the recirculation of water and chemicals from tank A onto the dishes. Note that water circulated from tank A mostly returns to tank A and, similarly, water that circulates from tank B mostly returns to tank B. Thus, mixing of the two tanks is minimized, but may not be completely eliminated. Wash A is further illustrated in FIG. 1. FIG. 1 shows a door-style dishmachine 10 with tank A 12 and tank B 16. Tank A 12 is associated with pump 14, which pumps the composition from tank A 12 through a line to the wash arms 20 and out nozzles 22 onto the dishes. Tank B 16 is associated with pump 18, which pumps the composition from tank B 16 through a line to the wash arms 20 and out nozzles 22 onto the dishes. The lines from tank A 12 are shaded to indicate the flow of composition from tank A 12 to the wash arms 20 and out nozzles 22 onto the dishes.

Figure 2:
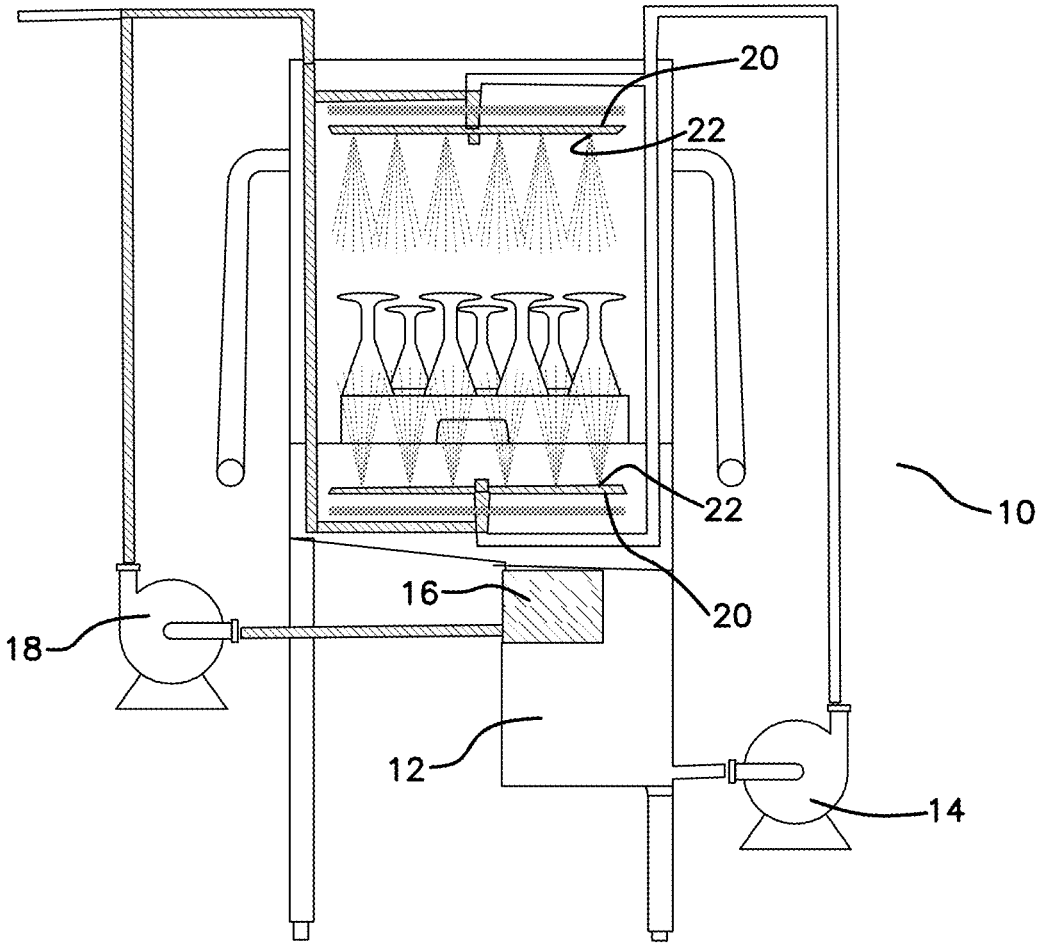
FIG. 2 illustrates the flow of composition from Tank B.

Wash B refers to the recirculation of water and chemicals from tank B onto the dishes. Note that wash B does not necessarily come after wash A in the sequence of events. Wash B is further illustrated in FIG. 2, which is identical to FIG. 1 except that the line from tank B 16 is shaded to indicate the flow of composition from tank B 16 through the line to the wash arms 20 and out nozzles 22 onto the dishes.

Figure 3:
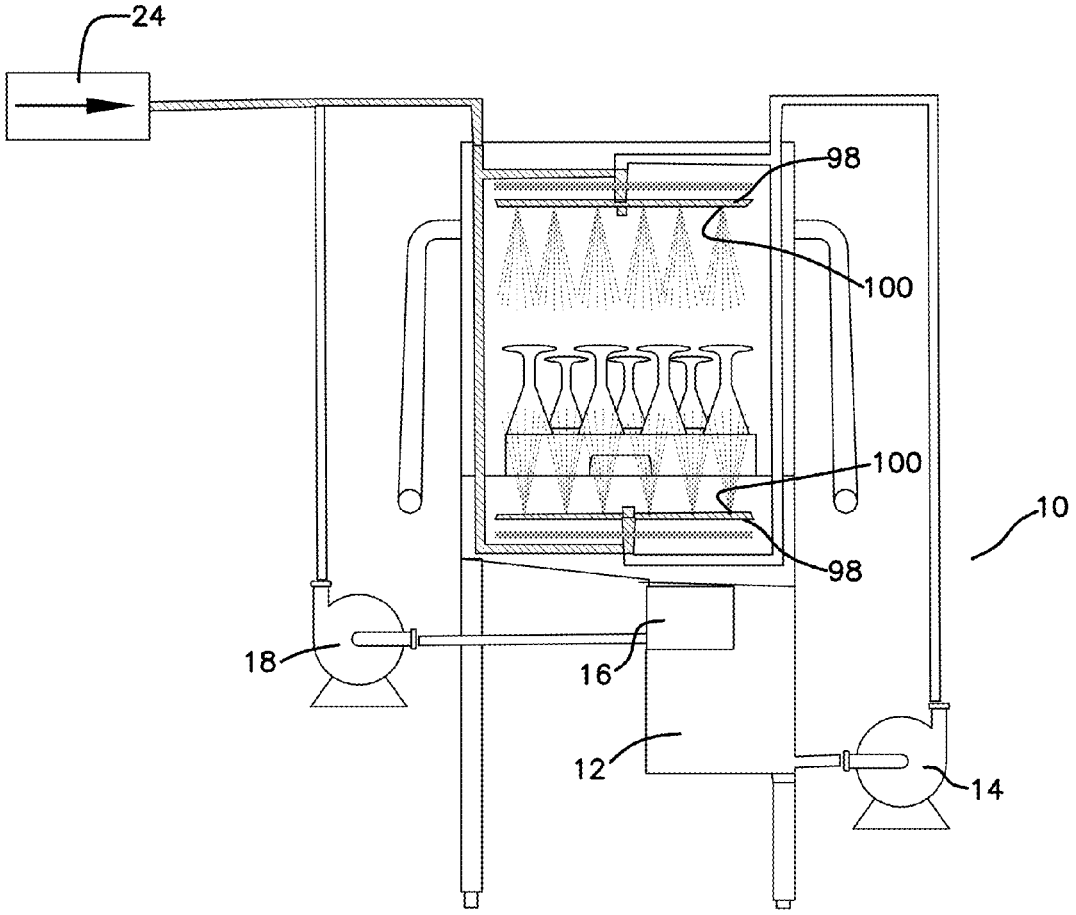
FIG. 3 illustrates the flow of fresh water.

Rinse A refers to the spray of fresh water onto the dishes. This may also be referred to as the final rinse. It may contain rinse additive, sanitizer, or other GRAS materials. Rinse A is further illustrated in FIG. 3. FIG. 3 shows a source of fresh water 24, which may come directly from the municipal water supply under pressure, or may be pumped from a water tank on the machine or external to the machine. The fresh water 24 flows through a line to the rinse arms 98 and out nozzles 100 onto the dishes.

Figure 4:
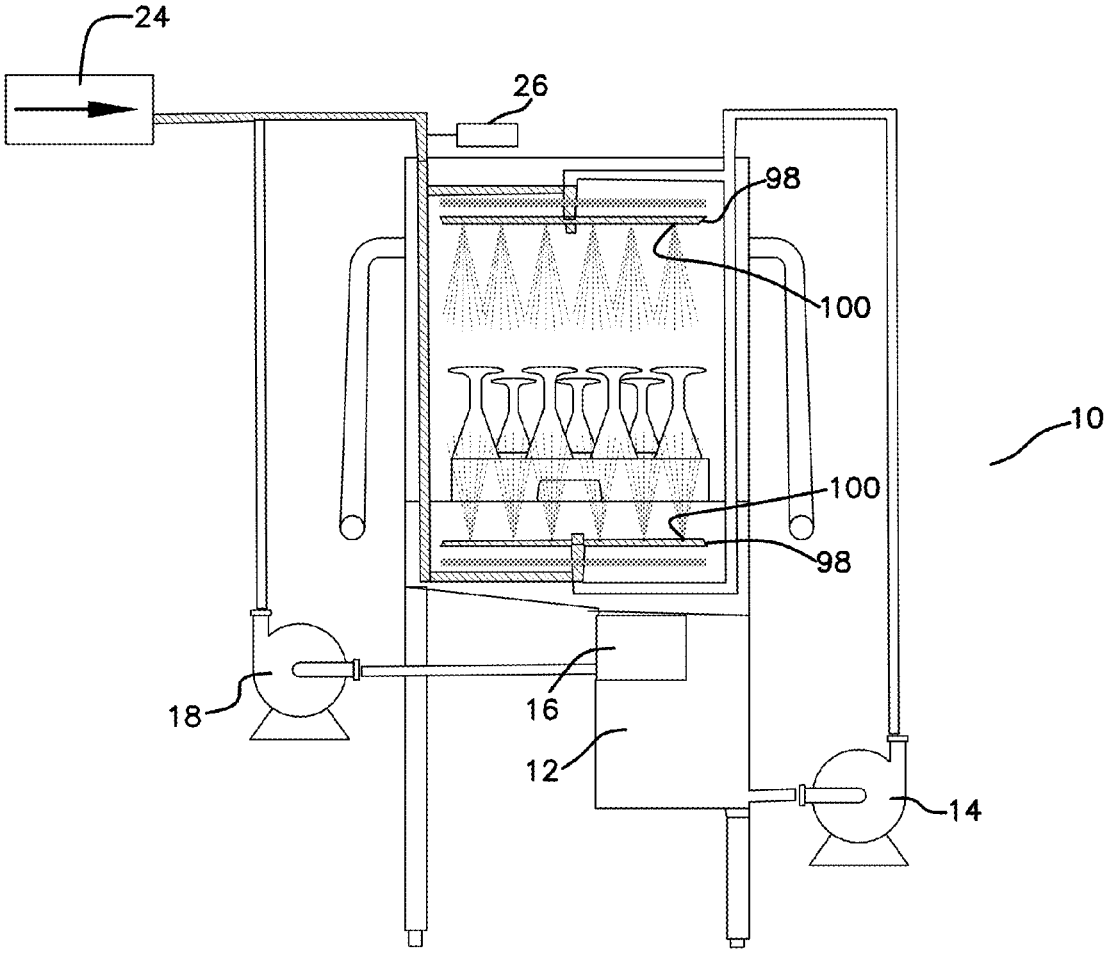
FIG. 4 illustrates the flow of fresh water with chemical injection.

Rinse B refers to the spray of water containing chemical B onto the dishes. This is a direct spray and is not circulated like a wash step. This could be a dynamic addition of chemical B into a fresh water stream (as shown in FIG. 4), or chemical B could be a ready-to-use solution that is sprayed onto the dishes without further dilution from a solution tank or container. FIG. 4 shows chemical being injected into a fresh water from a fresh water source 24 at 26. The combination of the fresh water and chemical travels through a line to rinse arms 98 and out nozzles 100 onto the dishes.

Rinse A and Rinse B can be a fresh water supply under pressure, or can be a tank of fresh water that is pumped into the dishmachine.

The chemical addition to all tanks can be accomplished in a number of ways including with a conductivity controlled dispenser, timed or periodic addition of chemical, or injection of chemical into the water stream before or after the tank.

In the method, tank A and tank B are at least partially isolated from each other. Separation of tank A and tank B can be achieved by various methods. Note that complete or 100% separation of tank B from tank A is not required for the machine. Even a partial separation with partial mixing of the two tanks has been found to be incrementally beneficial. In some embodiments, tank A and tank B are separated and the dishmachine provides a separation so that the mixing is reduced or minimized. In some embodiments, the dishmachine provides at least 80%, at least 90%, at least 99.9%, or at least 99.99% separation of the tank A and tank B fluids. Said differently, in some embodiments, no more than 20%, no more than 10%, no more than 0.1%, or no more than 0.01% of the tank A and tank B fluids mix.

A dishmachine cycle in a typical door- or hood-type dishmachine or under counter machine has two main steps: a wash and a rinse. Using the definitions from above, this sequence may be illustrated as:

| | |
|---|---|
| Wash A | Rinse A |

In the disclosed method with a dishmachine with at least two tanks, several steps may be added to this cycle, although certain features can be embodied in only one or two additional steps. It should be noted that the overall total dishmachine cycle length does not need to be increased, regardless of the number of steps in the process. Improved results can be seen with multiple steps without increasing the total cycle length. In some embodiments, a process with several steps can be generically described as follows:

| | | | | | |
|---|---|---|---|---|---|
| Wash A | Wash B | Rinse B | Wash A | Wash B | Rinse A |

The six steps of this cycle sequence are outlined as follows:

1. Wash A circulates a solution of composition A from tank A
2. Wash B circulates a solution of composition B from tank B
3. Rinse B sprays a mixture of composition B and fresh water onto the dishes
4. Repeat step 1 with a potentially different time duration
5. Repeat step 2 with a potentially different time duration
6. Rinse A sprays fresh water onto the dishes—final rinse In some embodiments, a specific example of this six-cycle sequence can use an alkaline detergent as composition A and an acidic detergent as composition B. This process could include the following:

1. Wash A circulates the alkaline A detergent onto the dishes. The purpose of this step is to penetrate the alkaline sensitive soils and to wash off the bulk of the food soils.

2. Wash B circulates the acidic B detergent onto the dishes. The main purpose of this step is to wash off and neutralize the alkalinity from the dishes. Neutralizing the alkalinity in this step allows the following Rinse B step to be more effective and to be shorter in duration. That directly reduces the amount of chemical B and the amount of water used to deliver composition B, which is a significant water, chemical, and energy cost reduction.

3. Rinse B sprays a concentrated solution of acid B onto the dishes. The strong acid penetrates and loosens acid-sensitive soils. In this example, fresh water is used to deliver the acid B. As mentioned above, since wash B neutralizes the alkalinity on the dishes, the duration of Rinse B can be quite short, saving chemicals, water, and energy for the overall system.

4. Wash A again circulates the alkaline A detergent onto the dishes. This step removes soils loosened in the previous step and further strips off alkaline sensitive soils.

5. Wash B again circulates the acidic B detergent. The acidic nature of the B detergent is particularly useful at removing and neutralizing the alkaline detergent from the dishes. Therefore, the wash B step duration can be relatively short, but more importantly, it allows the final rinse A step duration to be reduced tremendously with respect to time and/or water volume. By pre-neutralizing the alkaline detergent from the dishes, the final rinse A step can be very short since most of the hard-to-rinse materials are already removed or neutralized. Providing for a short final rinse water spray brings huge savings since this water is typically heated to high temperatures (180° F.), thus saving a large amount of energy as well as water.

6. Rinse A sprays hot fresh water onto the dishes. The energy required to heat this water is the single most expensive part of the dishwashing operation. Having an acidic wash B step beforehand allows the volume of water used in the rinse A step to be significantly reduced. Either the duration of rinse A can be reduced, or the water flow rate of rinse A can be reduced, with the overall result of using less water.

Note that the circulated wash A solution ultimately drains into tank A, and that the wash B and rinse B solutions ultimately drain into tank B, either completely or partially. The means of obtaining this separation is explained below.

In the above example, fresh acid is delivered only in the rinse B step, but is captured and re-utilized advantageously in both the wash B steps. This saves on the overall amount of chemistry needed. Not only does the acid not mix with the alkalinity, thus neutralizing it, but the acid is utilized in other steps. The current trend in dishmachine development is to use lower amounts of water, both in the wash tank and in the fresh rinse volumes. Smaller amounts of wash water mean that the wash tanks are dirtier and have high amounts of alkalinity, thus making the dishware harder to rinse clean. Smaller amounts of rinse water make it especially more challenging to get the dishes rinsed clean. This method addresses those challenges. By utilizing an acidic wash before the final rinse, significantly lower amounts of water can be used while achieving excellent cleaning and rinsing results. The duration time for each of the steps is adjustable and is dependent on the particular chemistry employed and on the water and washing action of the machine. An alternative to adjusting the step duration is to adjust the flow rate of each step. A lower flow rate can be equivalent to a shorter duration in terms of the amount of water or wash solution being utilized in the step. In some steps it may be advantageous to change the duration where in other steps it may make sense to change the flow rate. Therefore, step durations and step flow rates are preferably independently adjustable. Some examples of changing step durations include the following:

- If the wash B step contains an enzyme, then the wash B step would be relatively longer in duration than the other steps, since enzymes in general require a longer contact time for cleaning performance.
- If the wash B step contains an acid, then the wash B step(s) would be relatively short since acids are quick acting in general.
- The first wash A step's purpose is mainly to wash off large food particles with mechanical action. Since this purpose is achieved relatively quickly, the first wash A will be relatively short compared to the second wash A which has the purpose of removing stubborn films and stains.
- When a destainer or oxidizer chemical is used in the rinse B step, a low flow rate with a long duration would be preferable so as to have a high concentration of chemical with a long contact time.

The above example illustrates just one possible sequence of steps. In general the wash B and rinse B steps can be inserted in three different places: (1) at the beginning of the cycle; (2) in the middle of the cycle (as shown in the example above); or (3) before the final rinse cycle (as shown in the example above). Numerous combinations can be envisioned with the B steps inserted into one, two, or all three of the above-mentioned places in the sequence. Some of them are explained below.

| 2nd Example Sequence with B steps first | | | | |
|---|---|---|---|---|
| Wash B | Rinse B | Wash A | Wash B | Rinse A |

In this example, the wash B and rinse B steps are first in the dishmachine cycle. Some soils react better when the acid step is first as opposed to second in the sequence. For example, this sequence could be employed in a type of restaurant serving high levels of protein, whereas the acid-second sequence would be employed in a restaurant serving high levels of starch. Furthermore, depending on the mechanical configuration and on the chemistry employed, either both wash B and rinse B can be separately employed, or they can be combined into one single wash B step. This example sequence is shown immediately below:

| 3rd Example Sequence with combined B Steps | | | | |
|---|---|---|---|---|
| Wash A | Wash B | Wash A | Wash B | Rinse |

The combined B steps can be employed when tank B is completely isolated from tank A and from rinse A. When tank B is totally separated and regains all of its water each step, then there is no need for the rinse B step to add more water and composition B. The chemical B can be delivered into tank B instead of into rinse B with the resulting elimination of the rinse B step. The advantages are (1) elimination of the water consumption introduced in the rinse B step, and (2) conservation of chemical B usage. The chemical would be re-used over and over again, assuming that nearly 100% of the B solution is recovered each cycle. This sequence would also work well with the "level control" method described below.

Other useful sequence combinations are shown below, but the list is not all inclusive as the possible configurations are too numerous to list:

| Example Sequence with 9 steps | | | | | | | | |
|---|---|---|---|---|---|---|---|---|
| Wash B | Rinse B | Wash A | Wash B | Rinse B | Wash A | Wash B | Rinse B | Rinse A |

| Example Sequence with 8 steps | | | | | | | |
|---|---|---|---|---|---|---|---|
| Wash B | Rinse B | Wash A | Wash B | Rinse B | Wash A | Wash B | Rinse A |

| Example Sequence with 7 steps | | | | | | |
|---|---|---|---|---|---|---|
| Wash B | Rinse B | Wash A | Wash B | Rinse B | Wash A | Rinse A |

| Example Sequence with 6 steps | | | | | |
|---|---|---|---|---|---|
| Wash A | Wash B | Rinse B | Wash A | Wash B | Rinse A |

| Example Sequence with 5 steps | | | | |
|---|---|---|---|---|
| Wash A | Wash B | Rinse B | Wash A | Rinse A |

| Example Sequence with 4 steps | | | |
|---|---|---|---|
| Wash A | Wash B | Rinse B | Rinse A |

| Example Sequence with 3 steps | | |
|---|---|---|
| Wash A | Wash B | Rinse A |

It is important to note that each of the individual steps in the sequences can adjustably be shorter or longer and have higher or lower flow rates, depending on the chemistry and mechanical configuration. The above sequences are adaptable mainly to a high temperature door-type or hood-type dishmachines, or undercounter dishmachines, but other single tank machines can be utilized. For example, a low temperature, chemical sanitizing door-type dish machine could be used where the temperature of this type of machine is lower, but the wash B and/or rinse B steps include the addition of chemical sanitizer. Also, the tank. B or rinse B water could be heated. If the tank B water is heated, the wash B step contributes to the overall thermal sanitizing impact of the dishmachine. Heating tank B will ultimately allow the usage of even less final rinse water A since the rinse A step will then not require as much water or contact time to complete the sanitation requirements. Likewise, a heated rinse B step contributes to sanitization with the resulting usage of less final rinse water and ultimately less water usage overall for the dishmachine. The B steps listed above could be heated to 165° F. to have this contribution effect, or could be heated as high as 180° F. for a larger contribution. The disclosed methods could also be adapted for use in glass washers, or other batch-style machines.

Dishmachine Designs for Separating Tank A and Tank B

Water Overflow Method

With this method, the intention is to keep tank B substantially full to the top with composition B and water, thereby preventing wash A water from entering the tank. By ensuring that tank B is full during the wash A step(s), the wash water from tank A will be prevented or restricted from flowing into and mixing with tank B. Conversely, by design, tank B is not completely full during the wash B or rinse B step(s) and the B water will deliberately be directed to refill tank B.

Figure 9:
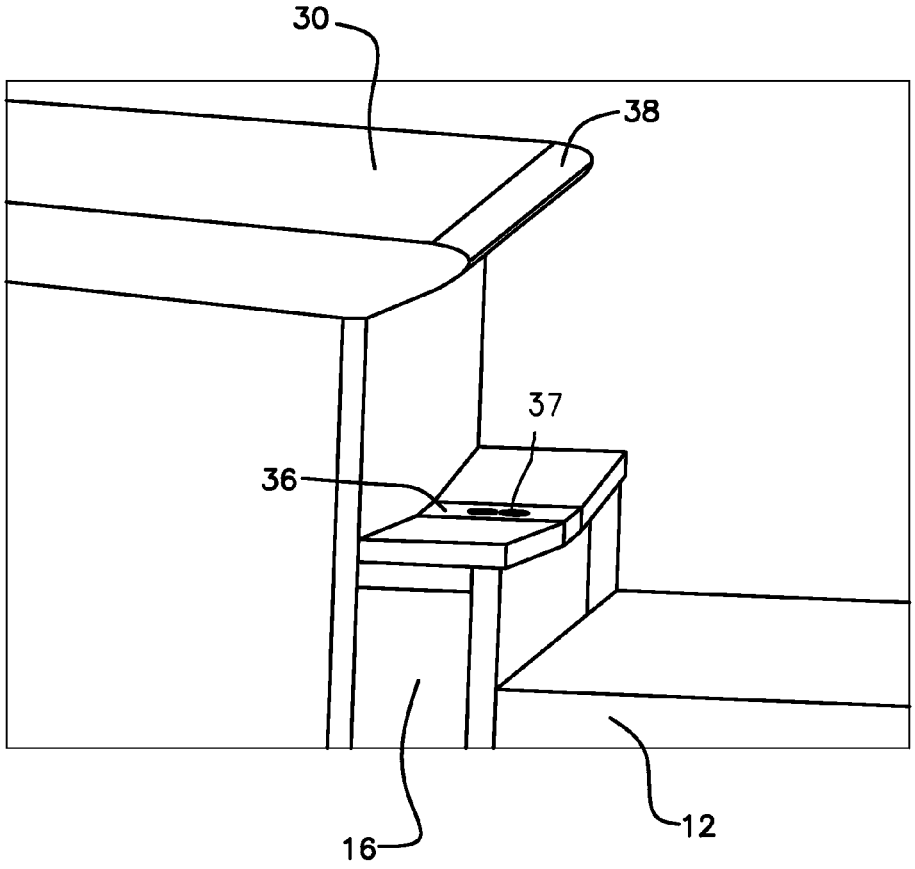
FIG. 9 further illustrates the waterfall embodiment, which includes a ledge over tank B.
Figure 10A:
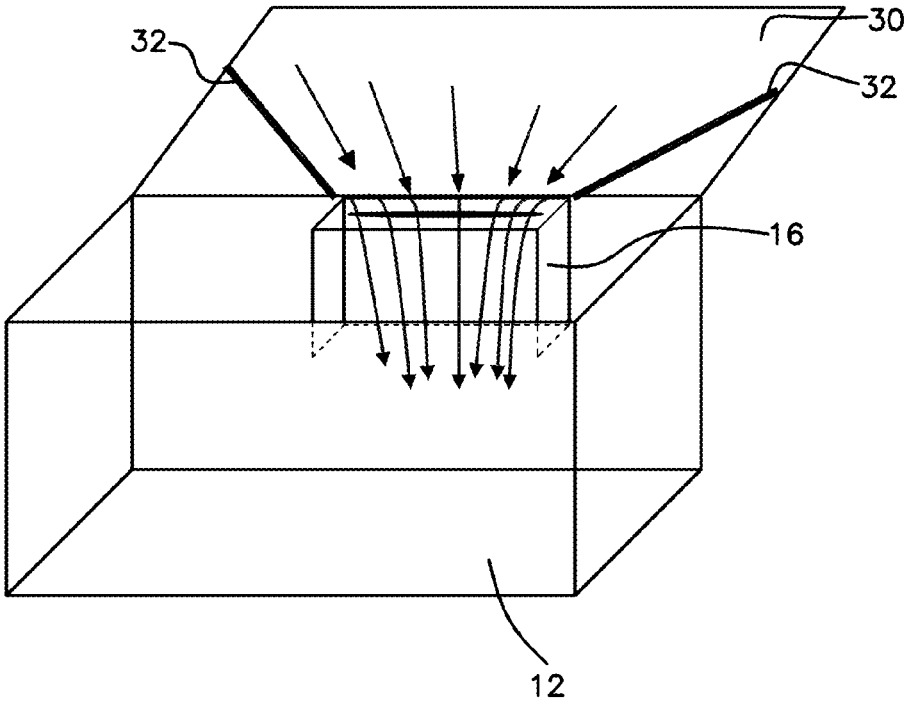
FIG. 10 illustrates the flow of fluid from the dishmachine floor.
Figure 10B:
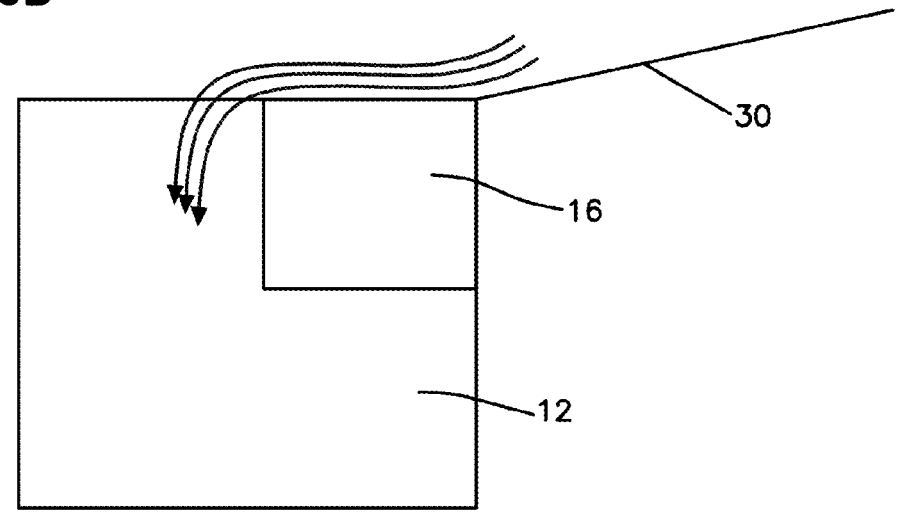
Figure 11:
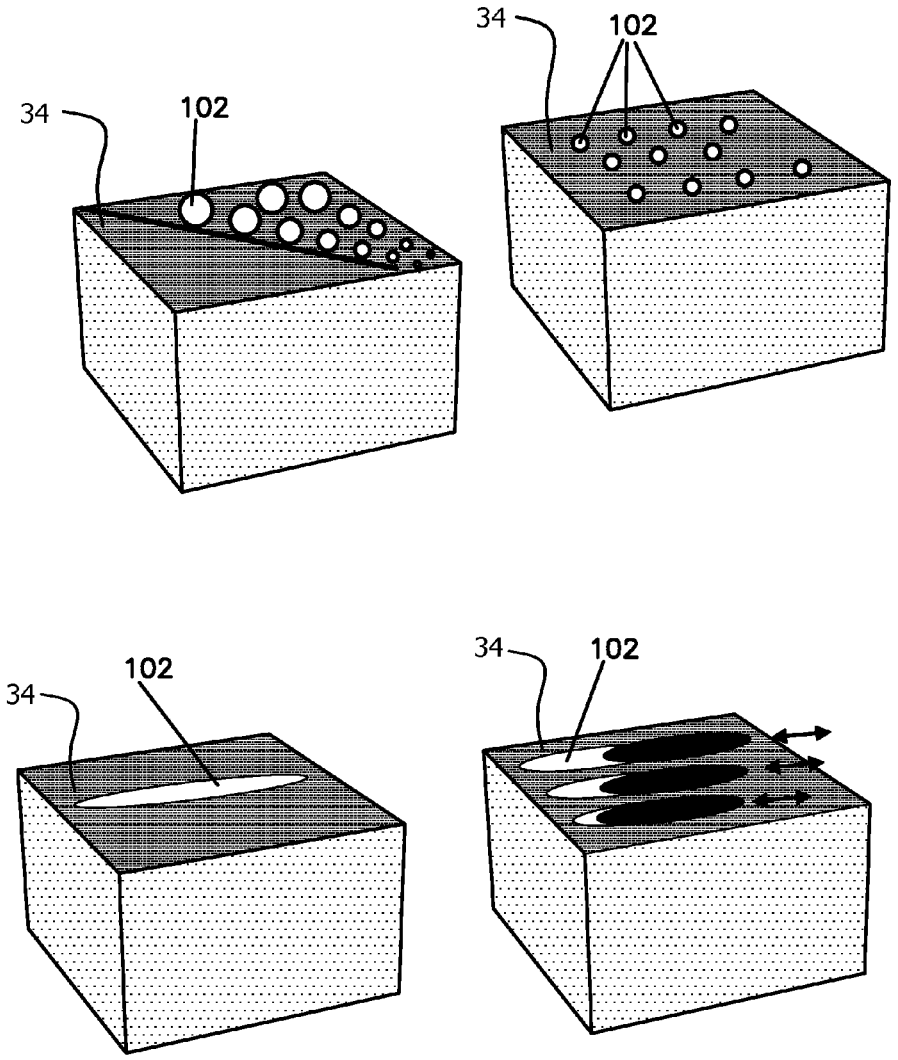
FIG. 11 illustrates various cover designs for the top of tank B.

The design and drawings for this "water overflow" method are shown in FIGS. 10-A, 10-B and 12. FIG. 10-A shows tank A 12 and tank B 16. The dishmachine also includes a floor 30 where the floor has one or more channels 32. During the dishmachine operation, the water circulated or sprayed within the dishmachine falls to the floor 30 of the machine and is then directed by the channels 32 over the top of tank B 16. Tank B 16 has an optional cover 34 on it (shown in FIG. 11) to prevent turbulent mixing of the water overflowing the top of tank B 16. FIG. 9 shows a side view of tank B 16 and tank A 12 with the floor 30 directing water to tank B 16 and tank A 12. FIG. 9 also shows a secondary cover 36 with a hole in it. Cover 34 includes strategically designed holes or slots 102 to allow water to flow into tank B 16 if tank B is not completely full. These are shown in FIG. 11. FIG. 10-B shows a side view of tank A 12 and tank B 16 with the water from the dishmachine floor 30 overflowing tank B 16 into tank A 12.

During the dishmachine operation, water is circulated from tank B 16 with a pump 18 during the wash B step. Thus, as the pump 18 draws wash water from tank B 16, the level in tank B falls, thereby allowing the wash B water to return and refill the tank. There may be some loss of water so the tank may not completely refill itself. The rinse B step or rinse A step can be used to refill the tank B to the top. Any excess water will overflow into tank A. Whenever tank B 16 is completely full the cascading water from the floor 30 flows over the top of tank B 16 and falls into tank A 12. This overflowing of water is particularly advantageous when the wash A step is being conducted since it is desirable to minimize the mixing of the wash A solution into the wash B solution, and vice versa. This method of separating tank A and tank B can be further described using the following sequence:

1. Wash A circulates a solution of composition A from tank A 12. Since tank B 16 is full, most if not all of the wash A water flows over tank B 16 and returns to tank A 12.
2. Wash B circulates a solution of composition B from tank B 16. The pump 18 draws water from tank B 16 thus lowering the level of tank B 16. Water returning from the pump spray is directed from the floor 30 over the top of tank B 16 and mostly enters into tank B 16 since the tank is not full at the time.
3. Rinse B sprays a mixture of composition B and fresh water onto the dishes. The rinse B spray falls and is also directed toward tank B 16 thus completely filling the tank to the top. Any excess wash solution overflows into tank A 12. This is the mechanism for keeping tank B 16 full and for adding composition B to tank B 16.
4. Repeat step 1 with a potentially different time duration
5. Repeat step 2 with a potentially different time duration
6. Rinse A sprays fresh water onto the dishes during the final rinse. Like the rinse B step, the rinse A step fills tank B 16 to the top and any excess overflows into tank A 12. In this manner, the rinse A water keeps tank B 16 and tank A 12 clean by adding fresh water to each tank every cycle.

Additional drawings for various designs of the top of the cover 34 of tank B 16 are shown in FIG. 11. FIG. 11 shows there are several holes 102 of different sizes, designed to catch slower moving liquid and detour faster moving liquid. Exemplary shapes for the holes include circles of varying or uniform sizes, ovals, ovals that may be selectively opened and closed, rectangles or slots that may optionally be selectively opened and closed, and the like. The slots and holes may optionally be adjustable. Adjustable slots are useful to make adjustments as water flows are changed after the machine is installed and running. The general principle for design of the holes and/or slots is to prevent turbulent flow of the wash A solution into the full tank B 16. A high speed laminar parallel flow over the top of full tank B 16 is most effective at transferring the water back into tank A 12 without causing mixing with tank B 16 as the water flows over the top of tank B 16. Parallel laminar flow is achieved by having a smooth top of the tank B 16 cover 34 and having the back edge of the slots or holes in the cover 34 be slightly lower than the front edge, so water doesn't knife down into tank B 16 at the back edge. The shape of the top of tank B 16 also plays a role in diverting the water properly. By making the top concave or convex and by changing the angle of the plate, an optimization of fluid flow can be achieved to minimize mixing and turbulent flow.

Figure 8A:
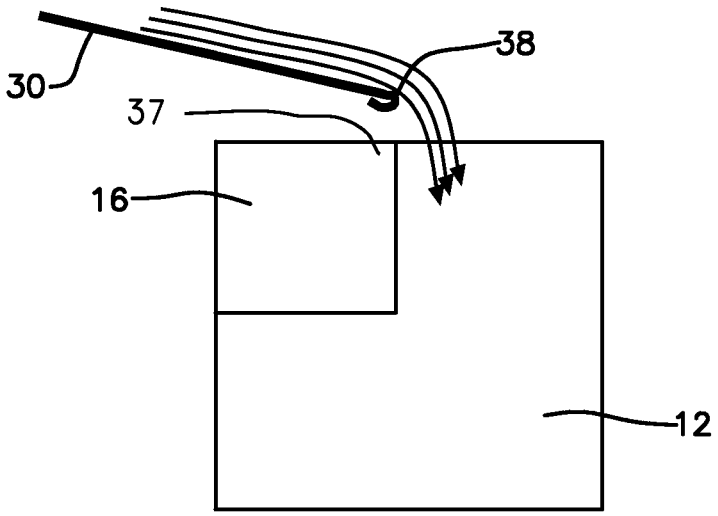
FIG. 8 illustrates an embodiment referred to as the "waterfall" which includes a ledge over tank B.
Figure 8B:
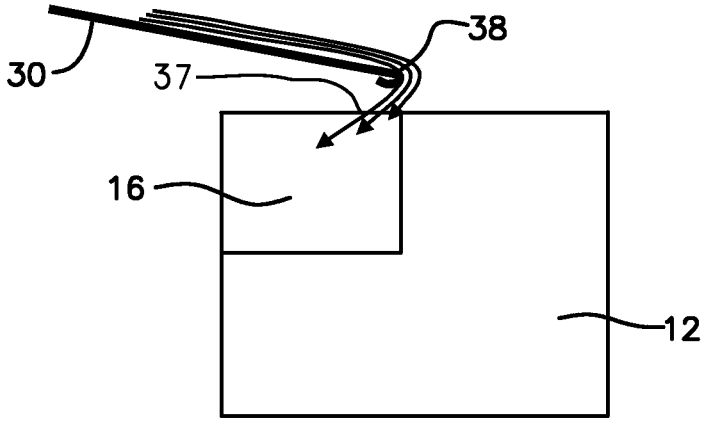

FIGS. 8 and 9 show a ledge 38 over an opening 37, also referred to as the waterfall concept. The ledge 38 of the waterfall concept causes the fast moving wash A water to move down the dishmachine floor 30 and jump or flow off the ledge 38 and completely over the opening 37 (FIG. 8-A). In contrast, the slow moving wash B water by design moves down the dishmachine floor 30 and follows the ledge 38, falling directly down into the opening 37 and into tank B 16 (FIG. 8-B). In a door- or hood-type dishmachine, the wash A water flow is several times higher than the wash B flow. The wash A flowrate is typically 60 GPM whereas wash B is only 5 GPM, or less. The waterfall design is a way to minimize mixing by taking advantage of the water flow rate difference.

Figure 12A:
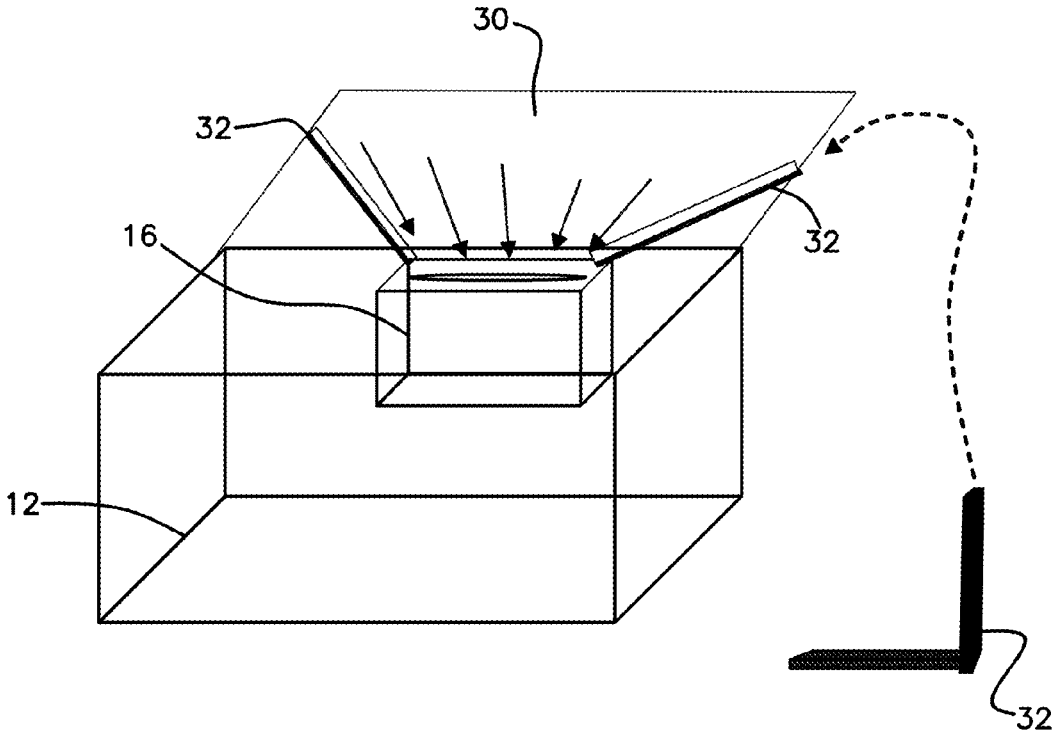
FIG. 12-A illustrates the use of channels on the dishmachine floor.
Figure 12B:
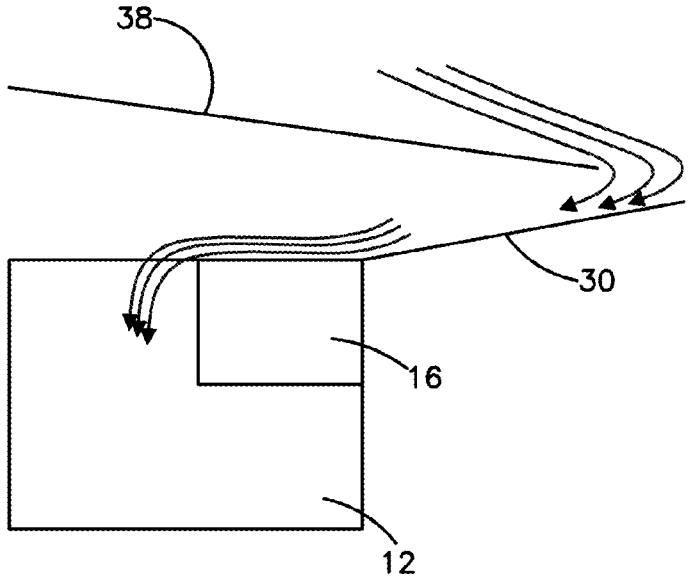

FIG. 12 shows one method for directing the wash and rinse water to the top of tank B. FIG. 12-A shows a view of the channel 32, which, in one embodiment can be an L-shaped piece of material or edge that comes up from the dishmachine floor 30. The height of the channel can be adjusted depending on water flow rates for the specific machine. A tall channel will direct all water to tank B 16. However, a relatively short (low vertical height) channel will allow fast moving water (wash A) to spill over the channel and thus will go directly into tank A 12. The slower moving water (wash B or rinse B) will not spill over and will be mostly directed to tank B 16.

FIG. 12-B incorporates a deflector plate 38, which sits above the floor 30 and protects tank A 12 and tank B 16 from water from the machine simply falling into either tank. The deflector plate 38 catches water as it drains from the dishmachine and directs it to a portion of the floor 30 which then channels it into either tank A 12 or tank B 16.

Positive Diverter Method

In this embodiment, a mechanically activated diverter plate or plates are used to positively direct all fluid to the tank of choice (tank A, tank B, or a combination thereof). All or some water drawn from tank A, tank B, rinse A, or rinse B could be diverted into tank A, tank B, or a combination thereof. The mechanical diverter can be driven by a motor, electromagnetic device, a physical action such as a linkage driven by the door opening or closing action, some other device, or a combination of these. Since the water flows are directed mechanically, there is very little (less than 0.1%/per cycle) mixing of tank A and tank B. As a result, tank B would lose very little water and would not need to be refilled as often. The final rinse A water would be used to replenish the losses from both tanks, and the rinse B step would not be needed to refill tank B. Periodically composition B would need to be added to tank B and likewise composition A would need to be added to tank A.

Figure 15B:
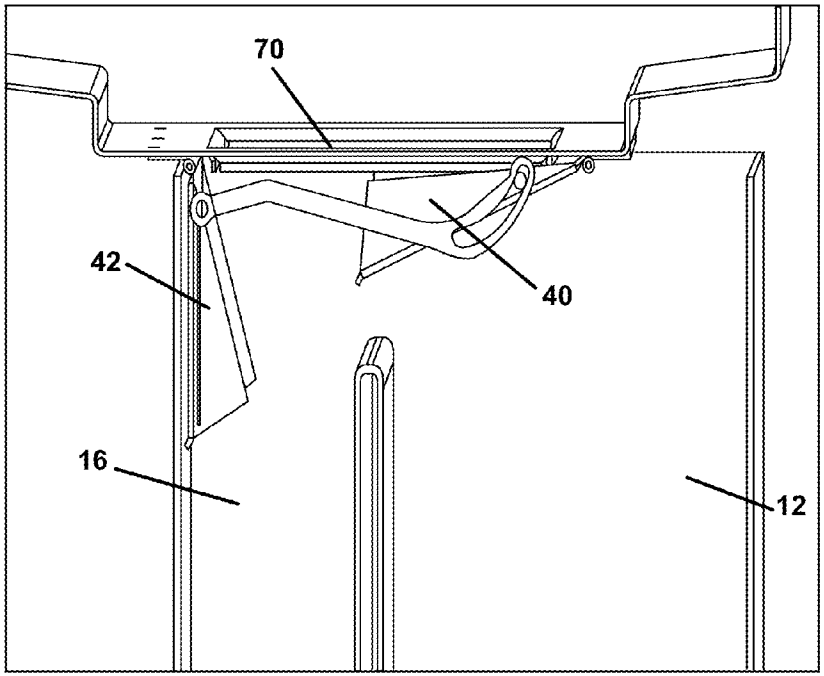
FIG. 15 illustrates an overlapping dual flapper method of fluid diversion.
Figure 15A:
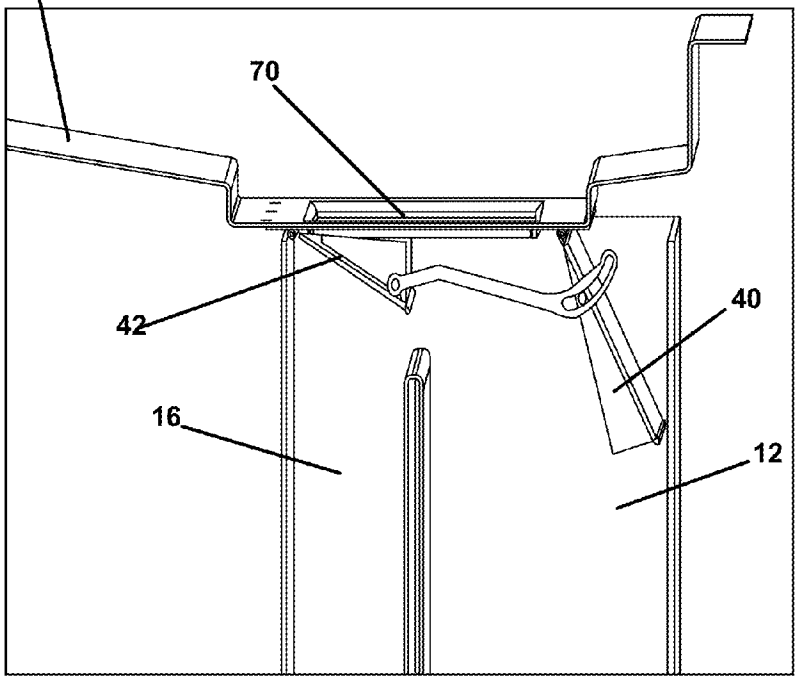
Figure 16A:
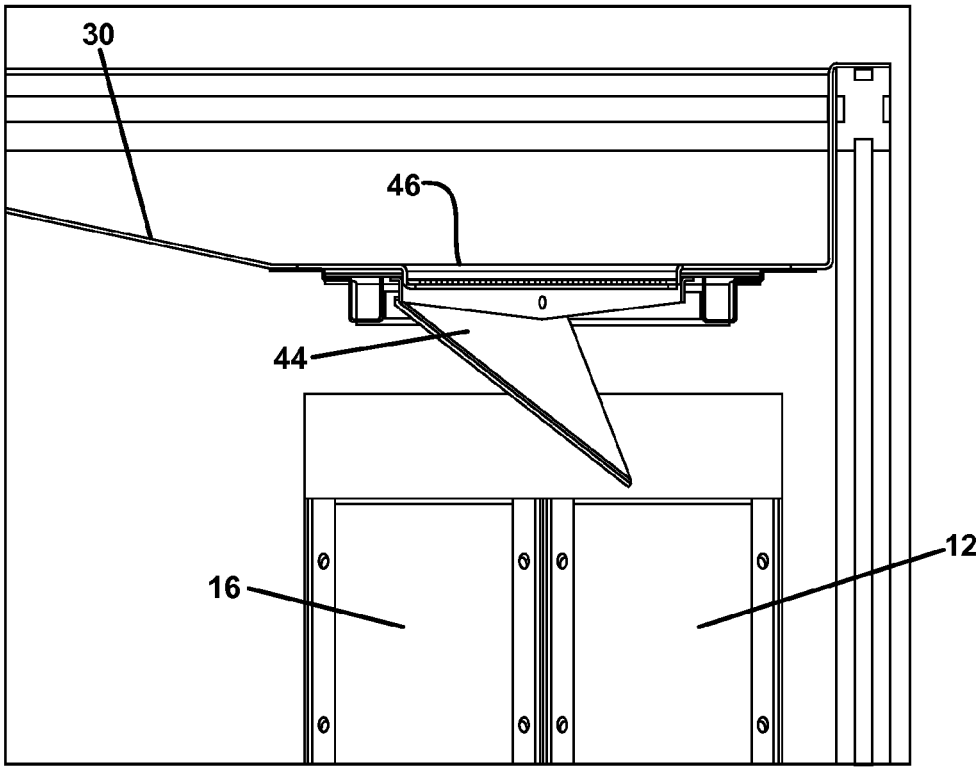
FIG. 16 illustrates a single diverter method of fluid diversion with a gutter leakage catch system.
Figure 16B:
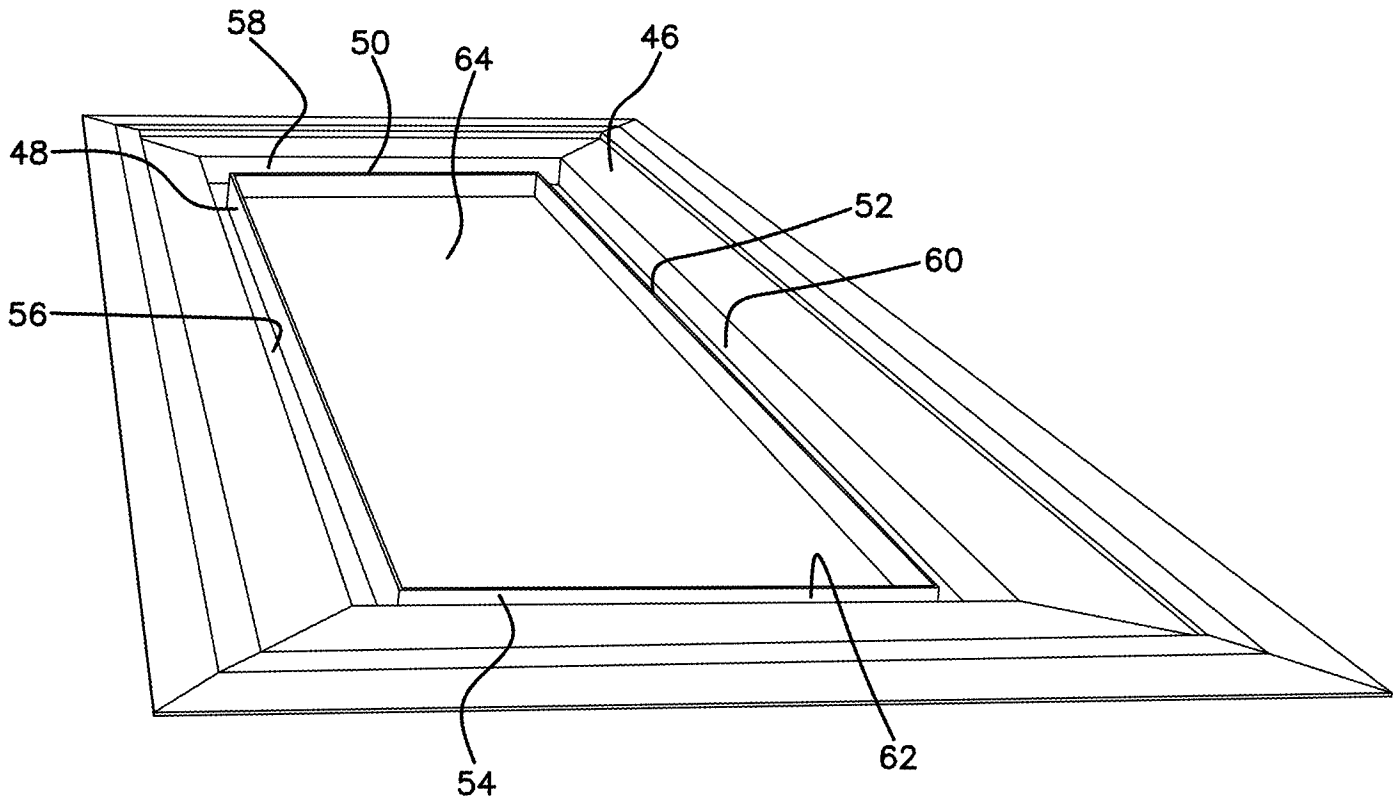
Figure 17A:
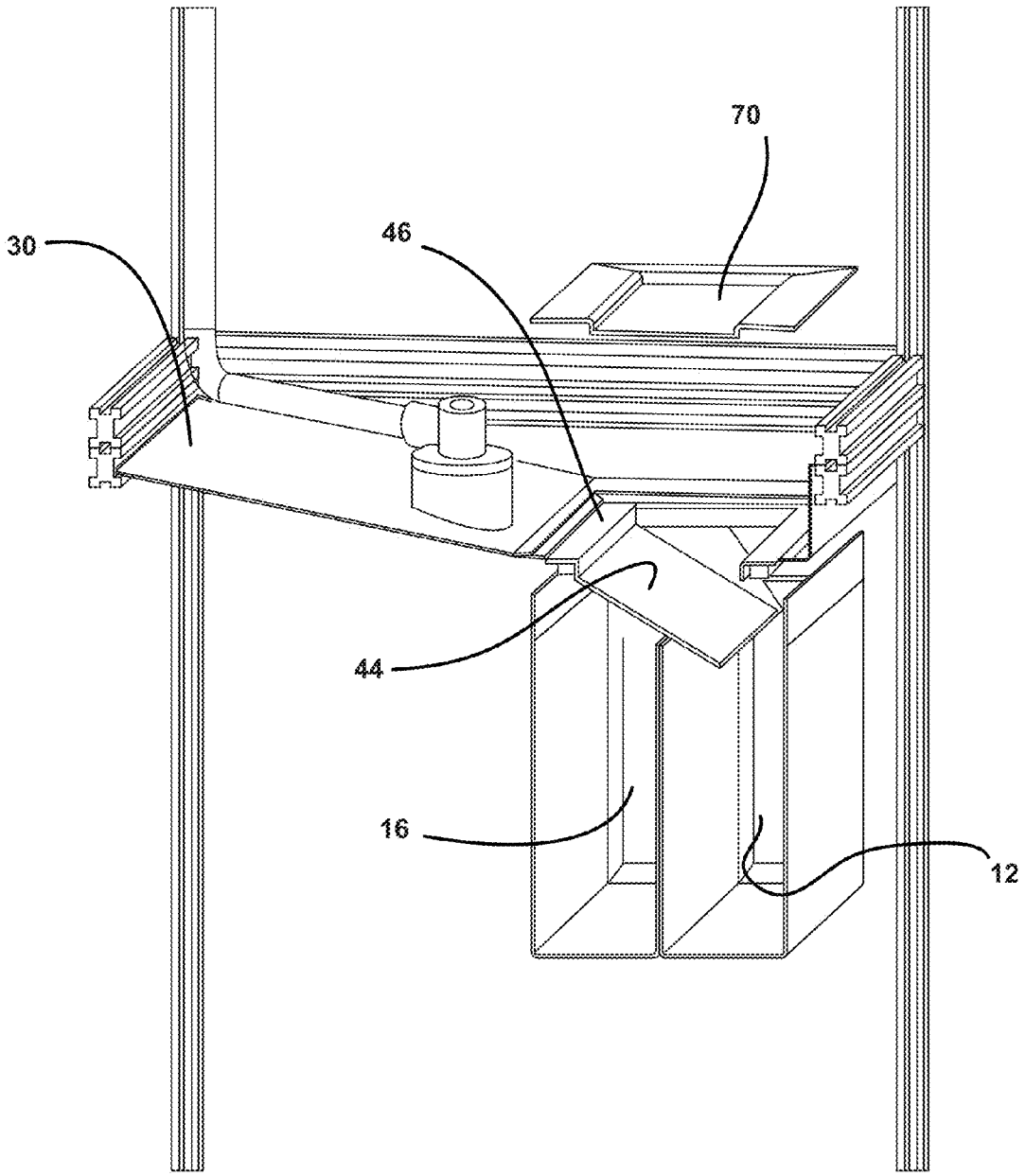
FIG. 17 illustrates a single diverter method of fluid diversion with a gutter leakage catch system.
Figure 17B:
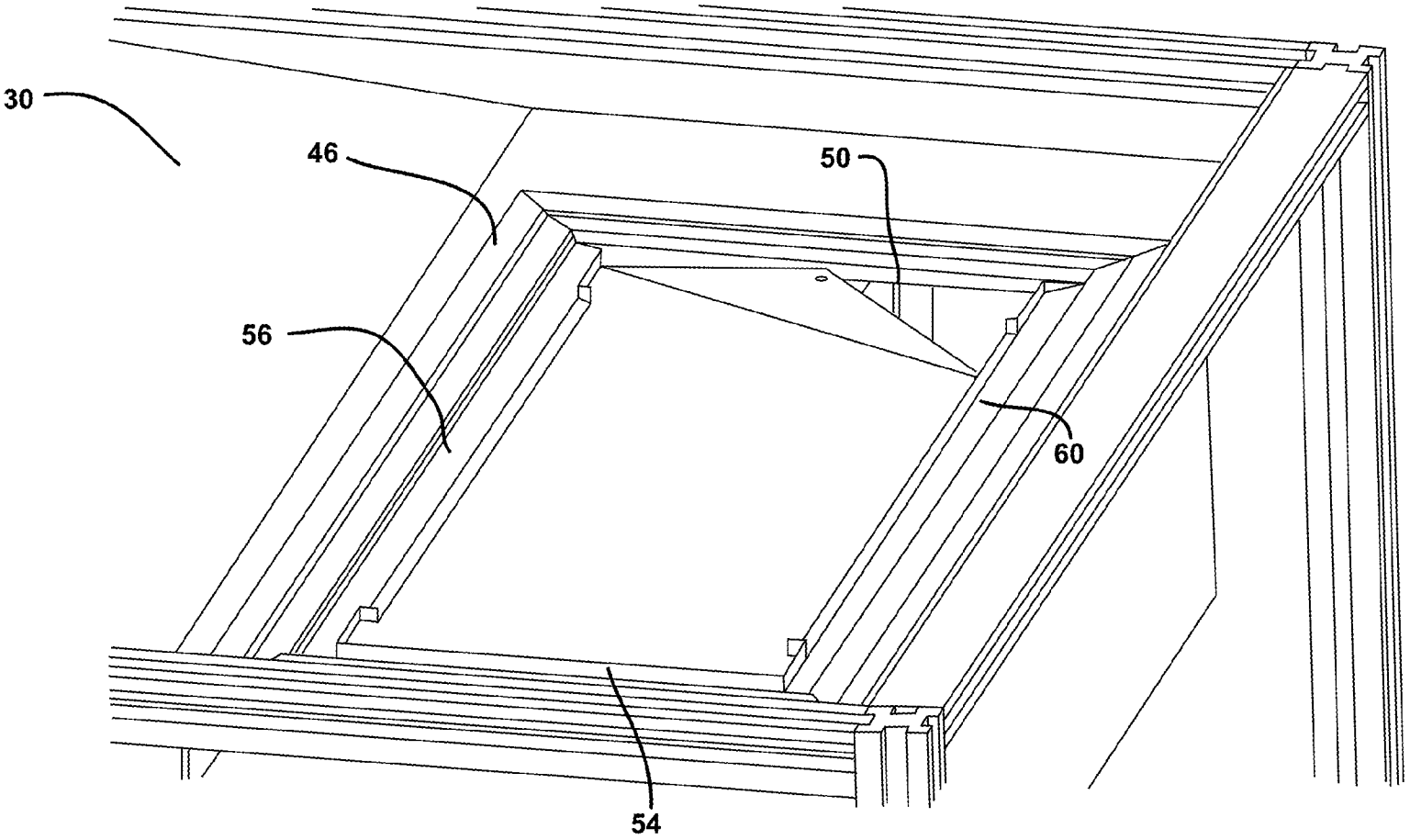
Figure 17C:
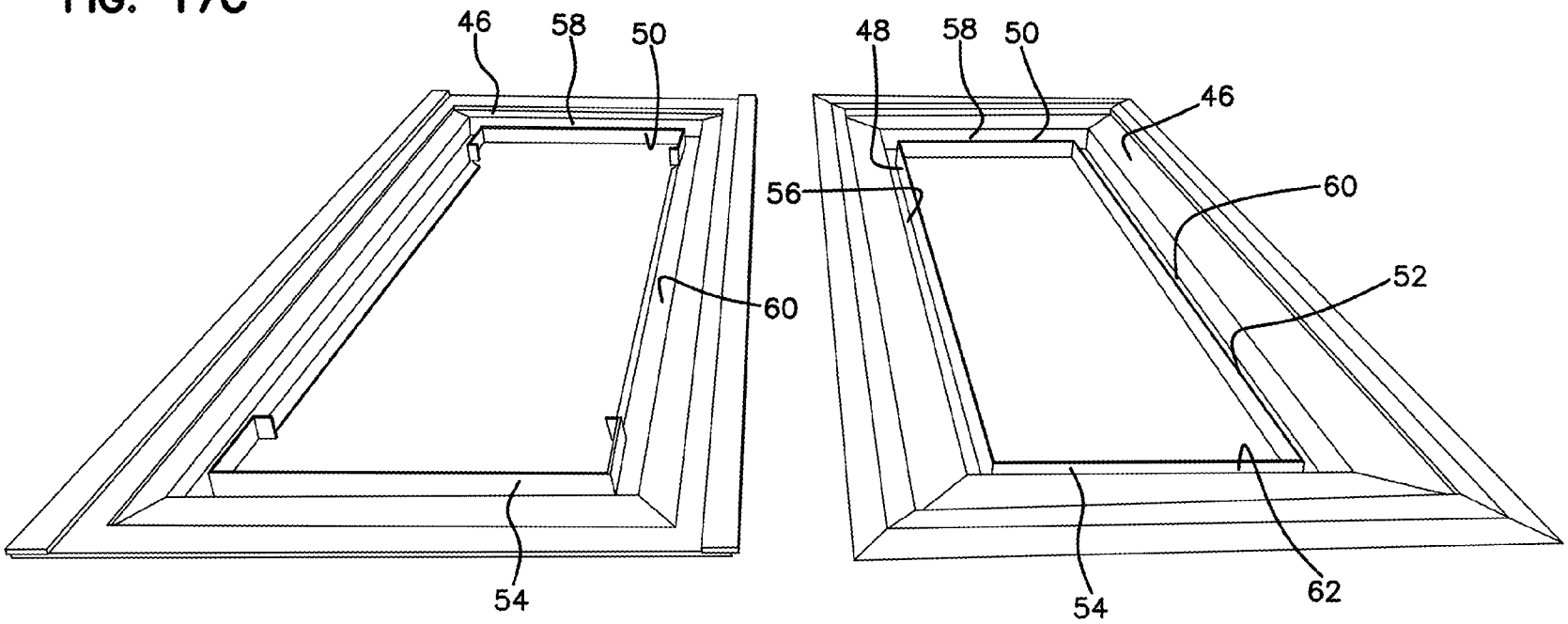

FIGS. 15, 16, and 17 show how the positive diverter method may be employed. FIGS. 15-A and 15-B show flappers 40 and 42 positioned to tank A 12 and tank B 16 respectively. One feature of this method is that the flappers 40 and 42 themselves overlap the opening of a strainer 70. This is effective at directing all water flowing through the strainer 70 to the desired tank. During operation, flapper 40 is open during wash A, thus providing an opening into tank A 12 such that the wash A water flows down the dishmachine floor 30 over the strainer 70 and through the opening provided by the absence of flapper 40 and into tank A 12. Likewise, flapper 42 is open during wash B, thus providing an opening into tank B 16 such that the wash B water flows down the dishmachine floor 30 over the strainer 70 and through the opening provided by the absence of flapper 42 and into tank B 16. In one embodiment, the water flowing over the flapper edge leaves the lower edge of the flapper at a height greater than the inner wall separating tank A 12 and tank B 16. This reduces the chances of the water leaving the flapper edge and wrapping backwards under the flapper and into the unintended tank. This is especially a risk at lower flow rates since the momentum of the water is low relative to the forces acting to adhere the water to the stainless edge of the flapper.

FIG. 16-A shows an embodiment with a tilted diverter 44 instead of the flappers 40 and 42. The tilted diverter 44 can be a substantially flat piece of material, such as metal, that can manually or electronically be actuated from side to side to selectively cause water from the dishmachine floor to flow into the desired tank. In a preferred embodiment, the lowest edge of the tilted diverter 44 is below the height of the inner wall separating the two tanks. This helps reduce the possibility that a flowrate in the range of 2.8-38 GPM or more could force water under the edge of the diverter and back upwards and over the inner wall separating the tanks.

FIG. 16-B shows an embodiment of an optional gutter plate 46. The gutter plate 46 has a center opening 64 that opens to the diverter 44 and tank A 12 and tank B 16. The gutter plate 46 includes recesses 56, 58, 60 and 62 around the opening 64. The recesses 56, 58, 60 and 62 may be surrounded by walls 48, 50, 52 and 54. In one embodiment, the recesses are surrounded by walls 50 and 54 only. FIG. 17-C shows the gutter plate 46 with two walls and with all four walls.

FIG. 17-A shows how the gutter 46, optional strainer 70 and diverter 44 can be used together to selectively direct water into either tank A 12 or tank B 16. FIG. 17-A shows dishmachine floor 30, tank A 12 and tank B 16. The dishmachine includes the tilted diverter 44. Sitting above the tilted diverter 44 is the optional gutter plate 46. Nested within the optional gutter plate 46 and sitting over the center opening 64 of the gutter plate 46 is a removable strainer plate 70. In practice, the strainer plate assists with catching the many different objects that fall out of racks during the washing process such as foodsoil, ware, straws and the like and prevent them from falling into the tanks. Some smaller objects such as certain foodsoil or toothpicks may make it through the strainer so it is beneficial to have a removable strainer for access to the tanks. The strainer and diverter are preferably removable by the operator to access these tanks. When a removable strainer is used, it may be beneficial to include an optional seal around the perimeter of the strainer to prevent any leakage past it, or to permit some leakage and direct the leakage into one or either of the tanks. In a preferred embodiment, the diverter and strainer are self-centering, reversible, and compressed only by gravity but permit some leakage around the perimeter that will be managed by the gutter system shown in FIG. 16-B.

The gutter 46 is a continuous fluid catch around the perimeter of the strainer 70. The gutter 46 has at least one fluid outlet port, which may be located in one of the corners of the opening 64 or along one of the sides of the opening 64. The outlet port is sized to permit leakage into a single tank at a rate greater than would be expected to enter the gutter 46. The amount of leakage into this gutter and into the desired tank may be in the range of 0.4 ounces/second to 1.0 ounce/second. In some embodiments, the gutter drains onto the diverter 44 and then into the desired tank or directly into the desired tank. This is accomplished by allowing two overflow edges on the gutter (as seen in FIGS. 17-B and 17-C that overlap the diverter. For example, when the diverter is positioned to direct fluid to tank A 12 (as seen in FIGS. 17-A, and B), the majority of water flows over the strainer 70 and onto the diverter 44 but the water that leaks around the perimeter flows into the gutter 46 and either leaks along the right edge directly into tank A 12 or leaks along the left edge onto the diverter and into tank A 12. In either case, all leakage is directed to tank A 12. The same is true when the diverter is positioned to drain to tank B 16. Most water flows through the strainer 70 onto the diverter 44 and into tank B 16, but some flows into the gutter 46 and either directly into tank B 16 or indirectly onto the diverter 44 and into tank B 16.

In some embodiments, the gutter drains exclusively into tank A 12. This would mean that some of wash B would drain into tank A 12 and not tank B 16. This may be acceptable since the amount of fluid circulated from tank B 16 is considerably smaller than the amount of fluid circulated from tank A 12, making any leakage from the gutter 46 during wash B minimal. In a preferred embodiment, there is no leakage from tank A to tank B or from tank B to tank A beyond the water that is adhered to the surfaces of the wash chamber and water that does not drain completely to either tank.

Level Control with a Float and Refill Valve Method

In some embodiments, the flow of additional water to tanks A and B is controlled with a level control design similar to the overflow method above. This embodiment uses a float inside the tank to trigger an electric signal to refill the tank automatically when it gets too low. Accordingly, some of the wash B water would return to tank B for re-use, but the tank would then automatically refill to the top with fresh water and more of composition B. Therefore, the rinse B step would not be needed to fill the tank to the top and would not be needed to charge tank B with chemical. The chemical would be added to the tank, not to the rinse step. This embodiment is beneficial because it refills the tank only as needed to compensate for water lost during the dishmachine cycle. The level control design would save additional water above what the overflow design saves, due to the removal of the Rinse B step.

Float Driven Deflector Method

Figure 5:
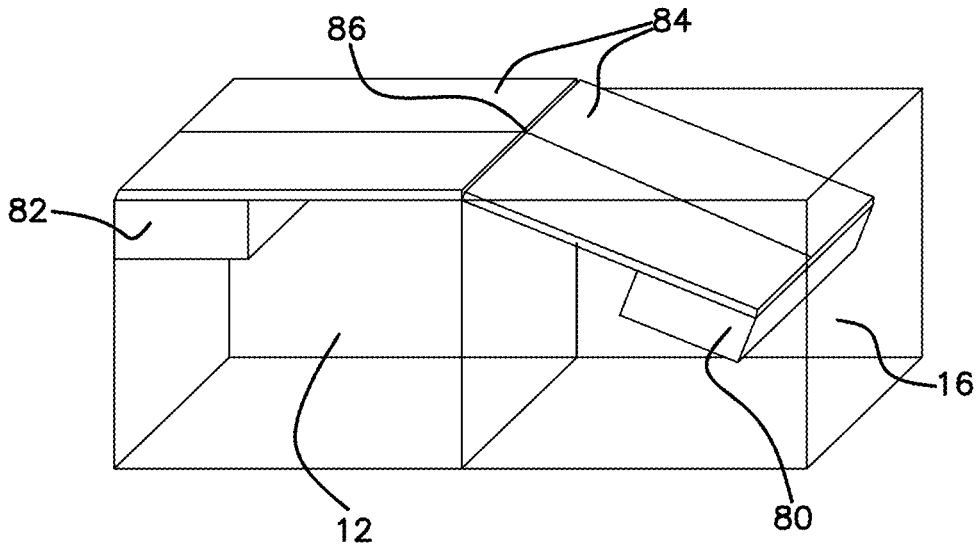
FIG. 5 illustrates an embodiment of the dishmachine using a float.

In some embodiments, flow to tanks A and B is controlled with a float system as shown in FIG. 5. In FIG. 5, water is being pumped from tank B 16 thus causing the water level in tank B 16 to drop and causing the float 80 to drop. The deflector plate 84 is angled concave towards its center so that water is directed towards and into tank B 16. The deflector plate 84 pivots at the divider 86 between the two tanks. Thus, conversely when tank A 12 is partially empty the float 82 and deflector plate 84 on the left will descend into tank A 12 thus directing water towards and into tank A 12. Whenever water is being pumped from tank B 16, the tank B 16 level drops, lowering the float 80 and the deflector plate 84, and directing water into tank B 16. Conversely, whenever water is being pumped from tank A 12, the tank A 12 level drops, lowering the float 82 and the deflector plate 84 and directing water into tank A 12. The desirable end result is that water pumped from tank B returns to tank B, and water pumped from tank A returns to tank A.

Figure 14:
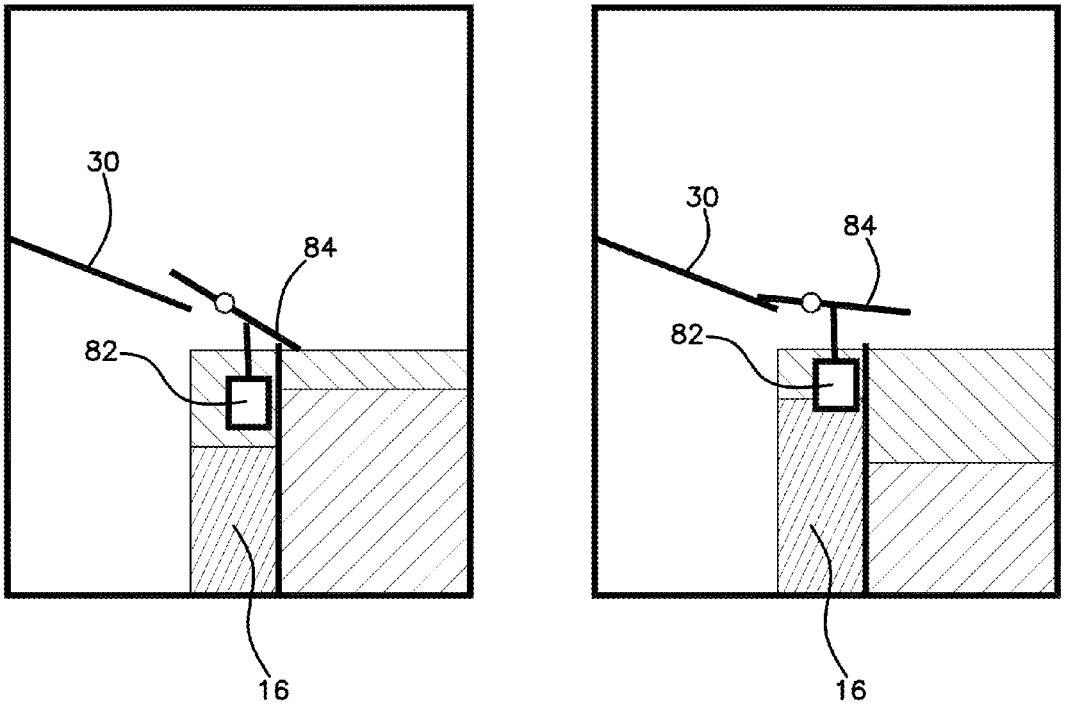
FIG. 14 illustrates an alternative embodiment of the Float Driven Deflector Method where the float also includes a diverter fin.

FIG. 14 shows another embodiment of the float driven deflector method. As shown in the figure, whenever the wash tank B 16 is low, the float 82 falls. Float 82 is attached to a rigid deflector plate 84. Thus, as the float 82 falls, it pulls on the rigid deflector plate 84 and causes it to tilt to the right and create an opening for the water to return to fill tank B. Note that float 82 is not required to fall with the water to the lowest level in tank B. It is possible for the float to fall only to a point where it pulls the diverter open enough to let water return to tank B. When water is being pumped from tank B, the liquid level in tank B always falls thereby lowering the float and causing the liquid to advantageously return from where it was pumped from. When tank B is full and water is being used from tank A, the float 82 will sit high in tank B 16 and push the diverter 84 closed towards the floor 30. Thus, any water that flows from the floor 30 will be directed over the diverter 84 and into tank A.

Floating Tank B Method

Figure 6:
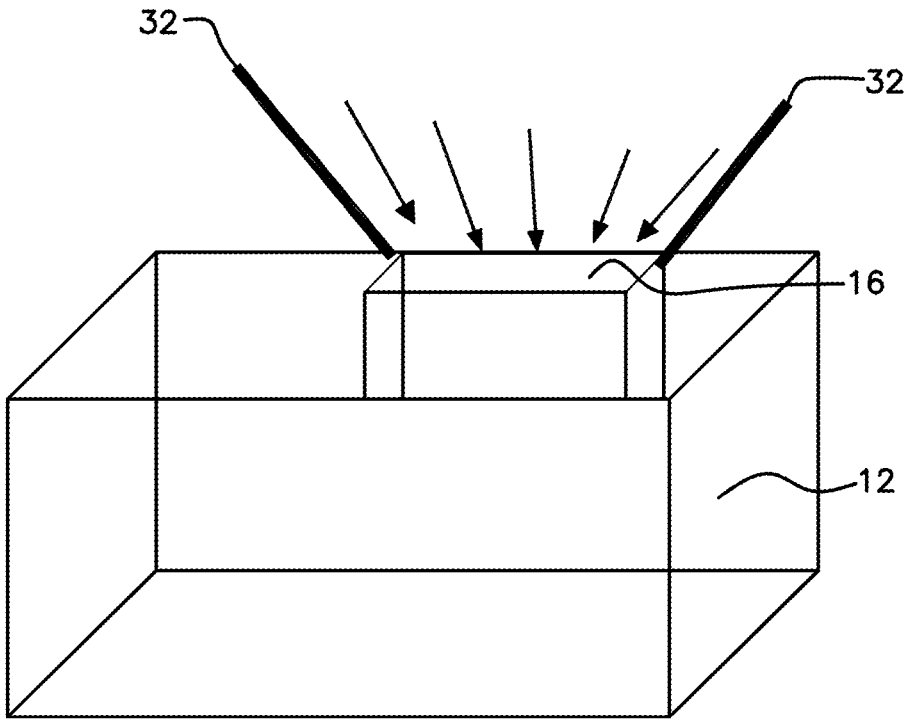
FIG. 6 illustrates an embodiment of the dishmachine using a floating tank B where tank B floats in tank A and sits high in tank A when tank A is full.
Figure 7:
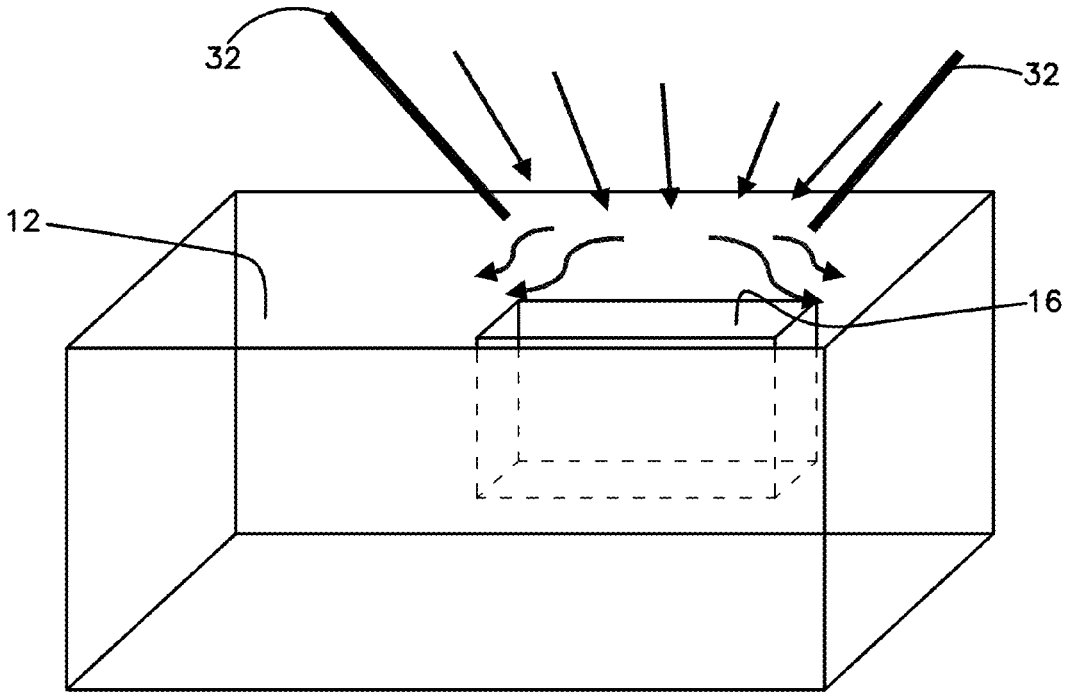
FIG. 7 shows the embodiment of FIG. 6 when tank A is not full and tank B sits low in tank A.

In some embodiments, tank B 16 actually floats within tank A 12, as shown in FIGS. 6 and 7. When tank A 12 is full (as shown in FIG. 6), tank B 16 is suspended high in tank A 12. All returning water will then be forced into tank B 16 as shown by the arrows. When tank A 12 is partially empty (i.e. when water is being pumped from tank A 12), tank B 16 is suspended low into tank A 12. The returning water goes over and around the lowered tank B 16 as shown in FIG. 7.

Total Fluid Capture and Control Method

The Water Overflow Method and the Water or Pump Actuated Deflector Method shown in FIGS. 5, 9, and 10 use the dishmachine floor 30 or deflector plates to selectively channel water towards tanks A 12 and B 16. Several factors influence the flow of fluid into one tank or the other. One factor is the angle or slope of the final fluid director plates. If the fluid director plate has a steeper angle, a greater velocity can be achieved by the fluid. If the fluid director plate has a flatter angle, a lower velocity can be achieved by the fluid. A second factor is the cross sectional area of fluid flowing towards the tanks. If the cross sectional area of the flowpath of fluid across the top of the fluid director plate is decreasing, the fluid will accelerate and have higher velocity. If the cross sectional area of the flowpath of fluid across the top of the fluid director plate is increasing, the fluid will decelerate and have lower velocity. A third factor is the edge shape of the end of the fluid director plate that releases to the tanks. Inertia will encourage the fluid to leave the final edge of the fluid director plate on a relatively straight trajectory on its fall into the tanks unless the shape of the edge encourages surface tension to dominate the fluid flow and pull the fluid down and back around the edge as shown in FIG. 8. A fourth factor is the material of the fluid director plates. The surface tension described above will be influenced by the choice of material for the fluid director plate. Metal surfaces have a relatively low surface tension whereas plastic surfaces have a high surface tension thus repelling and shedding water more quickly and completely. And a fifth factor is the relative position between the tanks and the fluid director plates. The horizontal and vertical relationship between the tanks and the edge of the fluid director plate will determine which fluid is captured in which tank. Modifying these five factors defines which fluid will flow into which tank. This design is not limited to three different fluids and two different tanks. If three or four or more fluids have unique flow rates, these factors can be adjusted to capture three or four or more fluids in three or four or more tanks.

Motor Driven Stopper Method

Figure 13A:
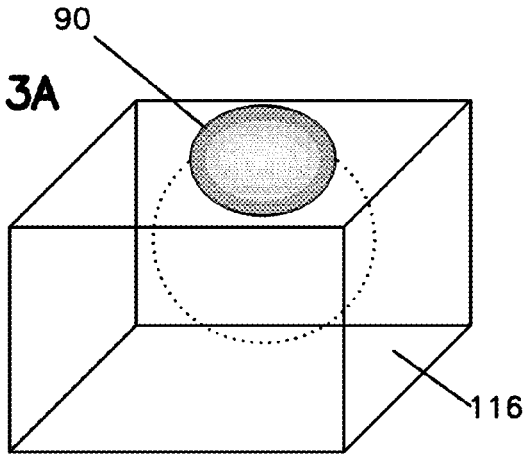
FIGS. 13-A, 13-B, and 13-C illustrate a ball valve closure mechanism on tank B.
Figure 13B:
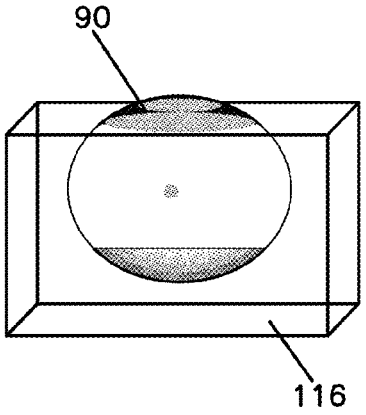
Figure 13C:
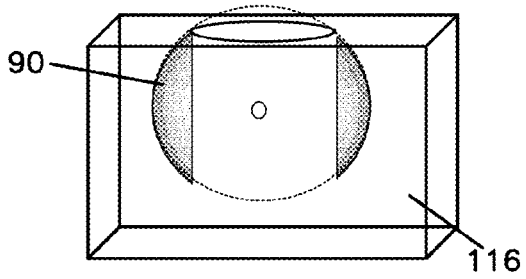

In some embodiments, the opening(s) 36 in tank B 16 can be further controlled by including an automated valve 90 or device that seals the openings 36 when a cycle is occurring that includes a fluid that is not desired to enter tank B 16. This valve 90 can automatically open when a cycle is occurring that includes water desired to enter tank B 16 as shown in FIG. 13-C. FIG. 13-B shows a ball valve mechanism 90 that plugs the hole 36 in tank B 16 when desirable and then opens the ball valve 90 (FIG. 13-C) to allow water in when needed to refill tank B 16. The drawings in FIG. 13 show the ball valve closure mechanism 90. Not shown is the motor that operates the valve. An electrically driven motor can be used to open and close the ball valve at the appropriate times as dictated by the machine programming signals. Note that either tank A or tank B could be equipped with the motor driven stopper and that other types of stoppers, in addition to a ball valve, could be employed. The motor driven or mechanical stopper method can prevent nearly 100% of the tank A fluid from entering into tank B, and vice versa.

Reducing Residual Water

Following a step in any of the wash and rinse processes, water and chemical solution remain on the interior surfaces of the machine and on the ware that is being washed. It is preferable to have this solution routed to the desired tank in order to further reduce or eliminate contamination of the tank solutions. The following methods can be employed to collect this residual water and direct it to the correct tank. In some embodiments, the start of the subsequent step in the wash process is delayed to allow more time for water to drain from the just-completed step into the appropriate tank. For example, after completion of the alkaline wash spray, the diverter 44 in FIG. 16-A may be kept in the desired position to divert the wash solution from the wash chamber into the alkaline tank for one or more seconds. This will allow the alkaline solution to drain off of the internal surfaces of the wash chamber and ware into the desired tank. Similarly, after the recirculated acid step, the diverter 44 in FIG. 16-A may be kept in the position to divert the wash solution into the acidic tank for one or more seconds.

In some embodiments, the diverter 44 is kept in the position to divert the wash solution into the appropriate tank for the start of the next step in the wash process. This is preferable in cases where it is acceptable to have a small amount of contamination of one tank with the wash solution from the other tank, but not acceptable to contaminate in the opposite direction. For example, if it is preferable to have some contamination of the alkaline tank with acidic wash solution, but it is not acceptable to contaminate the acidic wash tank with alkaline wash solution, the diverter 44 could be positioned to divert the first fraction of a second or seconds of acidic wash into the alkaline tank. This would result in the residual alkaline solution on the interior of the wash chamber and ware, plus the initial acidic solution, being diverted to the alkaline tank, and reducing contamination of the acidic tank with the residual alkaline solution.

In some embodiments, fresh water could be used at the end or beginning of a cycle for a short period of time. This would reduce the contamination even further. For example, following an alkaline wash step, a short spray of a fraction of a second or seconds of fresh water would rinse much of the residual alkaline solution into the alkaline tank without contamination of the alkaline tank by acidic solution. The residual solution in the wash chamber at the end of this step would primarily be fresh water, so when the acidic step was started, the diverter 44 could be positioned to immediately route the wash solution into the acidic tank.

The present invention may be better understood with reference to the following examples. These examples are intended to be representative of specific embodiments of the invention, and are not intended as limiting the scope of the invention. Variations within the disclosed concepts are apparent to those skilled in the art.

EXAMPLE 1

Example 1 quantified the tank to tank leakage in a dishmachine with the design of FIG. 17-A. Fluid circulation flowrates were selected at 2.8, 7.0, and 38.0 gallons per minute and run for durations of 1, 5, 30, 60, 300, and 3600 seconds. The results are shown in Table 1.

TABLE 1

| Run # | Duration Seconds | Pump A Flowrate Gallons Per Minute | Pump B Flowrate Gallons Per Minute | Rinse Flowrate Gallons Per Minute | Diverter Position | Leakage To Opposite Tank Grams (mL) | Total Water Pumped Past Diverter Gallons | Effectivness leaked/diverted |
|---|---|---|---|---|---|---|---|---|
| 1 | 1 | 38 | 0 | 0 | Divert to Tank A | 0.24 | 0.63 | 99.9900% |
| 2 | 1 | 0 | 7 | 0 | Divert to Tank B | 0.00 | 0.12 | 100.0000% |
| 3 | 1 | 0 | 0 | 2.77 | Divert to Tank A | 0.14 | 0.05 | 99.9199% |
| 4 | 1 | 0 | 0 | 2.77 | Divert to Tank B | 0.10 | 0.05 | 99.9428% |
| 5 | 1 | 0 | 38 | 0 | Divert to Tank B | 0.03 | 0.63 | 99.9987% |
| 6 | 1 | 7 | 0 | 0 | Divert to Tank A | 0.30 | 0.12 | 99.9321% |
| 7 | 5 | 38 | 0 | 0 | Divert to Tank A | 0.33 | 3.17 | 99.9972% |
| 8 | 5 | 0 | 7 | 0 | Divert to Tank B | 0.06 | 0.58 | 99.9973% |
| 9 | 5 | 0 | 0 | 2.77 | Divert to Tank A | 0.23 | 0.23 | 99.9737% |
| 10 | 5 | 0 | 0 | 2.77 | Divert to Tank B | 0.08 | 0.23 | 99.9908% |
| 11 | 5 | 0 | 38 | 0 | Divert to Tank B | 0.04 | 3.17 | 99.9997% |
| 12 | 5 | 7 | 0 | 0 | Divert to Tank A | 0.26 | 0.58 | 99.9882% |
| 13 | 30 | 38 | 0 | 0 | Divert to Tank A | 1.01 | 19.00 | 99.9986% |
| 14 | 30 | 0 | 7 | 0 | Divert to Tank B | 0.05 | 3.50 | 99.9996% |
| 15 | 30 | 0 | 0 | 2.77 | Divert to Tank A | 0.10 | 1.39 | 99.9981% |
| 16 | 30 | 0 | 0 | 2.77 | Divert to Tank B | 0.42 | 1.39 | 99.9920% |
| 17 | 30 | 0 | 38 | 0 | Divert to Tank B | 0.10 | 19.00 | 99.9999% |
| 18 | 30 | 7 | 0 | 0 | Divert to Tank A | 0.10 | 3.50 | 99.9992% |
| 19 | 60 | 38 | 0 | 0 | Divert to Tank A | 1.59 | 38.00 | 99.9989% |
| 20 | 60 | 0 | 7 | 0 | Divert to Tank B | 0.12 | 7.00 | 99.9995% |
| 21 | 60 | 0 | 0 | 2.77 | Divert to Tank A | 0.42 | 2.77 | 99.9960% |
| 22 | 60 | 0 | 0 | 2.77 | Divert to Tank B | 0.00 | 2.77 | 100.0000% |
| 23 | 60 | 0 | 38 | 0 | Divert to Tank B | 0.64 | 38.00 | 99.9996% |
| 24 | 60 | 7 | 0 | 0 | Divert to Tank A | 0.37 | 7.00 | 99.9986% |
| 25 | 300 | 38 | 0 | 0 | Divert to Tank A | 5.20 | 190.00 | 99.9993% |
| 26 | 300 | 0 | 7 | 0 | Divert to Tank B | 0.36 | 35.00 | 99.9997% |
| 27 | 300 | 0 | 0 | 2.77 | Divert to Tank A | 1.00 | 13.85 | 99.9981% |
| 28 | 300 | 0 | 0 | 2.77 | Divert to Tank B | 0.00 | 13.85 | 100.0000% |
| 29 | 300 | 0 | 38 | 0 | Divert to Tank B | 11.04 | 190.00 | 99.9985% |
| 30 | 300 | 7 | 0 | 0 | Divert to Tank A | 1.36 | 35.00 | 99.9990% |
| 31 | 3600 | 38 | 0 | 0 | Divert to Tank A | 26.00 | 2280.00 | 99.9997% |
| 35 | 3600 | 0 | 38 | 0 | Divert to Tank B | 35.20 | 2280.00 | 99.9996% |

The result was a worst case leakage amount from tank A to tank B of 35.2 ml at the 38.0 gpm and 3600 second test condition representing 2280 gallons of circulated fluid. This shows that the diverter drained gutter system is over 99.9% effective at diverting water back into either tank.

EXAMPLE 2

Example 2 determined the product and water usage of a simulated dual tank dishmachine versus a single tank dishmachine. For this example, a dual tank machine was simulated by using two dishmachines side-by-side. The first dishmachine contained alkaline detergent in its wash tank. The second dishmachine contained an acidic product in its wash tank. After washing the rack of dishes in the first dishmachine, the rack was immediately slid into the second dishmachine for the acidic product and final rinse. The following test parameters were used for the example:

Conventional Steps: Use One Single-Tank Dishmachine

1. Alkaline Wash: 45 seconds
2. Pause: 2 seconds
3. Fresh Water Final Rinse: 11 seconds Dual Tank Steps: Use Machine-1 and Machine-2:

1. Alkaline Wash 45 seconds
2. Pause 2 seconds
3. Acid Power Rinse 6 seconds (recirculated and re-used)
4. Fresh Water Final Rinse 5 seconds General Conditions:

Water source: 5 gpg water hardness tap water

Final Rinse Water:

- Flow Rate: 0.82 gallons in 11 second rinse
- 15 psig flow pressure
- 180 F

Alkaline Detergent:

- Solid Power, commercially available from Ecolab Inc.
- Control detergent set-point with conductivity controller Acid product:

- Urea Sulfate, 45% active solution
- Control acid concentration manually by taking pH measurements each cycle. Control at pH 4.0+/−0.5 by adding acid manually Dishmachines:

- Machine#1: Apex HT, commercially available from Ecolab Inc.
- Machine#2: ES-2000HT, commercially available from Ecolab Inc.
- Machine temperatures: Wash 155° F., Final rinse 180° F.
- All dishmachine cycles were a total of 58 seconds duration
- Use water meters on both machines to record volume used each cycle This example measured product and water usage for the simulated dual tank system that dosed twice the detergent as the single tank system, but used one-half as much fresh final rinse water per cycle. 20 cycles were run for both the single and simulated dual tank systems and the results were averaged. Product usage was determined by measuring the weight loss of the product with a balance. Water usage was determined using water meters attached to the inlet of the machines. The single tank wash used 1000 ppm of Solid Power alkaline detergent, which is considered a normal usage level for the industry. The final water rinse was set at 0.82 gallons of water in 11 seconds and the actual water rinse was measured at 0.82 gallons. The simulated dual tank test used 2000 ppm of Solid Power alkaline detergent, which is twice the normal usage level in the industry. The final water rinse was set at 0.42 gallons in 5 seconds. This final rinse was divided between the alkaline machine and the acidic machine with two seconds of final rinse water sprayed onto the dishes while in the acidic machine and three seconds of final rinse water sprayed onto the dishes while in the alkaline machine. The rack was first rinsed in the second, acidic machine and then the rack was moved back to the alkaline machine and rinsed again. The pH of the acidic tank was maintained at pH 4.0+/−0.5 by taking manual pH measurements each cycle and manually adding acid to maintain the target pH. Six dinner plates were placed into a dish rack for each test. The results are shown in Table 2.

TABLE 2

Average amounts of detergent, acid, and water usage over 20 cycles

| | Conventional Wash Cycle | Dual Tank with Acidic Power Rinse | |
|---|---|---|---|
| Detergent Used per cycle: | 2.5 | 2.1 | grams |
| Acid Used per cycle: | 0 | 0.68 | grams |
| Water Used per cycle: | 0.82 | 0.42 | gallons |

All consumption numbers were an average of 20 complete dishmachine cycles

Table 2 shows that the simulated dual tank dishmachine used less detergent, but more acid and approximately half the water of the single tank machine. The one-half water usage is significant not only in the water savings but also in the energy savings associated with having to heat half the amount of water. The detergent and acid usage can be further reduced my minimizing any carryover of acidic composition to the alkaline tank and vice versa. This emphasizes the importance of a system design that minimizes carryover between the two tanks.

EXAMPLE 3

Example 3 compared the cleaning performance of the simulated dual tank system with a single tank system.

For this example, tea stains were deposited onto ceramic tiles by preparing according to the following method. Three 2-liter beakers were filled with 180° F. 17 grain hard water and 50 teabags of Lipton brand black tea were placed into each beaker and allowed to steep for 5 minutes. After five minutes, the beakers were emptied into a hot water bath. 40 ceramic tiles were suspended on racks and lowered into the tea water bath. The tiles were allowed to remain in the tea water bath for 1 minute and then they were raised and allowed to remain outside of the tea water bath for 1 minute. This process was repeated for a total of 25 dip/raise cycles. The tiles were removed from the rack and allowed to air dry for at least one day and as long as two to three days.

Soil removal was calculated by taking photos of the tiles before and after cleaning and using digital image analysis. The digital image analysis is conducted by comparing digital photos of the stained tea tiles before and after washing. To calculate a percent soil removal number, the number of dark pixels (stained) on the AFTER pictures is subtracted from the number of dark pixels on the BEFORE pictures, and divided by the number of dark pixels on the BEFORE pictures:

$$(\text{BEFORE}-\text{AFTER})/(\text{BEFORE})\times 100=\%\ \text{Soil Removal}$$

The same procedure and dishmachine cycle settings were used as in Example 2. The final rinsing was done completely in Machine 1 for the single tank method and completely in Machine 2 for the simulated dual tank method.

For the test, the single tank method used Solid Power alkaline detergent at concentrations of 1000, 1200, and 1400 ppm and a measured final water rinse of 0.92 gallons in 11 seconds. The dual tank method used Solid Power at 1600, 1800, and 2000 ppm and a measured final water rinse of 0.46 gallons in 5 seconds. The results are shown in Table 3.

TABLE 3

| | Single Tank Method Alkaline Detergent Concentration | | |
|---|---|---|---|
| | 1000 ppm | 1200 ppm | 1400 ppm |
| % Soil Removal | 3% | 4% | 72% |
| | Simulated Dual Tank Method Alkaline Detergent Concentration | | |
| | 1600 ppm | 1800 ppm | 2000 ppm |
| % Soil Removal | 89% | 93% | 94% |

Tea stains on ceramic are very difficult for most detergents to remove at normal dosage levels. The single tank method was effective only at the highest concentration level. But, at 1400 ppm, the alkaline detergent can leave an alkaline residue on the dishware item. The simulated dual tank method was effective at removing the tea stains, but without leaving any alkaline residue on the coupons as shown in Example 4.

EXAMPLE 4

Example 4 determined the amount of residual alkalinity remaining on dinner plates after the final rinse cycle. For this example, a concentrated solution of Indicator P, also known as phenolthalein indicator, was sprayed onto the dinner plates immediately after the rack and plates were removed from the dishmachine. Indicator P turns bright pink when the pH is 8.3 or above and is clear or colorless below pH 8.3. Photos were taken within 1 second of spraying Indicator P. The amount and intensity of the pink color was then rated by comparing the photos of each plate. A rating of 1 is perfect with no pink color visible. A rating of 10 is the worst with a large amount of dark pink color.

The same procedure and dishmachine cycle settings were used as in Example 2. For this example, the single tank method used Solid Power alkaline detergent at concentrations of 1000 and 2000 ppm. This example varied the length of the final rinse and measured results after an 11 second, 9 second, 7 second, 5 second, and 3 second rinse. The flow rate was set to 0.82 gallons in 11 seconds. The dual tank method used Solid Power at 1000 and 2000 ppm. This example also varied the length of the final rinse for the simulated dual tank method and measured results after a 7 second, 5 second, and 3 second rinse. The flow rate was set to 0.82 gallons in 11 seconds. The results are shown in Table 4.

TABLE 4

| | Concentration of Indicator P on Plates | | | | |
|---|---|---|---|---|---|
| | 3 Second Rinse | 5 Second Rinse | 7 Second Rinse | 9 Second Rinse | 11 Second Rinse |
| | Single Tank Method | | | | |
| Indicator P Rating for 1000 ppm Solid Power | 8 | 4 | 3 | 2 | 1 |
| Indicator P Rating for 2000 ppm Solid Power | 10 | 8 | 5 | 3 | 2 |

TABLE 4-continued

| | Concentration of Indicator P on Plates | | | | |
|---|---|---|---|---|---|
| | 3 Second Rinse | 5 Second Rinse | 7 Second Rinse | 9 Second Rinse | 11 Second Rinse |
| | Dual Tank Method | | | | |
| Indicator P Rating for 1000 ppm Solid Power | 1 | 1 | 1 | Not Tested | Not Tested |
| Indicator P Rating for 2000 ppm Solid Power | 1 | 2 | 1 | Not Tested | Not Tested |

Table 4 shows that a short rinse in the single tank method leaves alkaline residue on plates. For the single tank method, a longer rinse (and thus more water) is needed in order to remove the alkalinity, especially the alkalinity levels needed to remove the tea stains in the single tank example in Example 3. The dual tank method has very little alkaline residue, even at the 3 second rinse and even when 2000 ppm of alkaline detergent was used.

The above specification provides a complete description of the disclosure. Since many embodiments of the disclosure can be made without departing from the spirit and scope of the invention, the invention resides in the claims.

We claim:

1. A method of washing articles in a dishmachine comprising:

a housing comprising a wash chamber inside the housing;

a first tank in fluid communication with the wash chamber;

a first pump for pumping fluid from the first tank into the wash chamber;

a second tank in fluid communication with the wash chamber;

a second pump for pumping fluid from the second tank into the wash chamber;

at least a first mechanism and a second mechanism constructed to maintain a first composition and a second composition at least 90% separate during the method, wherein the first mechanism comprises a diverter plate selectively movable between a first position and a second position, wherein the first position opens a flow path from the wash chamber into the first tank and the second position opens a flow path from the wash chamber into the second tank, and wherein the second mechanism comprises a gutter plate comprising a central opening and at least two walls on opposite sides of the central opening each forming a portion of a recess positioned on at least two sides of the diverter plate;

wherein articles to be cleaned are disposed within the wash chamber;

the method comprising:

A. filling the first tank with the first composition and filling the second tank with the second composition;

B. spraying the first composition from the first tank onto the articles in the dishmachine;

C. positioning the diverter plate to the first position, wherein at least 90% of the first composition sprayed onto the articles flows onto the diverter plate and into the first tank;

D. spraying the second composition from the second tank onto the articles in the dishmachine;

E. moving the diverter plate to the second position, wherein at least 90% of the second composition sprayed onto the articles flows onto the diverter plate and into the second tank; and F. spraying a fresh water rinse onto the articles in the dishmachine.

2. The method of claim 1, wherein the first composition is an alkaline composition.

3. The method of claim 1, wherein the second composition is an acidic composition.

4. The method of claim 1, wherein the first composition is an acidic composition.

5. The method of claim 1, wherein the second composition is an alkaline composition.

6. The method of claim 1, wherein steps B or D are repeated at least once.

7. The method of claim 1, wherein steps B through F are not longer than 5 minutes in total.

8. The method of claim 1, wherein steps B through F use no more than 1 gallon of fresh water in total.

9. The method of claim 1, wherein the second tank further comprises a top cover, an opening in the cover, and a valve in communication with the opening and configured to open and allow fluid to flow into the second tank.

10. The method of claim 1, wherein the gutter plate two comprises four walls along the sides of the central opening each forming a portion of the recess.

11. The method of claim 1, wherein the diverter plate is moved from the first position to the second position electronically.

12. The method of claim 1, wherein the diverter plate is moved from the first position to the second position mechanically.

13. The method of claim 1, wherein the diverter plate is moved to the second position at least 0.5 seconds after the spraying of the second composition starts.

14. The method of claim 1, wherein moving the diverter plate to the second position and spraying the second composition happen substantially simultaneously.

15. The method of claim 1, wherein the diverter plate is at least 99.9% effective at directing water to the intended tank.

16. The method of claim 1 further comprising:

spraying a freshwater rinse onto the articles in the dishmachine between steps C and D.

17. The method of claim 10, wherein the recess comprises a first recess disposed on a first side of the opening and a second recess disposed on a second side of the opening opposite of the first side of the opening.

18. The method of claim 17, wherein the first and second recesses comprise open ends forming a flow path from the recess to the opening.

19. The method of claim 10, wherein the gutter plate is positioned above the diverter plate.

20. The method of claim 19, wherein the gutter plate is constructed to allow for removal of the diverter plate from the dishmachine.

21. The method of claim 10, wherein the dishmachine further comprises a strainer.

22. The method of claim 21, wherein the strainer is removably positioned above the gutter plate.

23. The method of claim 10, wherein the first and second mechanisms are constructed to maintain the first composition and the second composition at least 99.9% separate during the method.

* * * * *